US007478804B2

(12) United States Patent
Yamada et al.

(10) Patent No.: US 7,478,804 B2
(45) Date of Patent: Jan. 20, 2009

(54) PAPER FEEDING APPARATUS, IMAGE FORMATION APPARATUS WITH PAPER FEEDING APPARATUS AND STORAGE MEDIUM STORING CONTROL PROGRAM THEREOF

(75) Inventors: Masatoshi Yamada, Aichi-ken (JP); Shingo Ito, Aichi-ken (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 376 days.

(21) Appl. No.: 10/670,338

(22) Filed: Sep. 26, 2003

(65) Prior Publication Data

US 2004/0061273 A1 Apr. 1, 2004

(30) Foreign Application Priority Data

Sep. 30, 2002 (JP) ..... 2002-285337

(51) Int. Cl.
*B65H 3/44* (2006.01)

(52) U.S. Cl. ..... 271/9.09; 271/9.08; 399/392

(58) Field of Classification Search ..... 271/9.09, 271/9.13, 9.08, 9.11; 399/392
See application file for complete search history.

(56) References Cited

U.S. PATENT DOCUMENTS

| | | | | |
|---|---|---|---|---|
| 4,285,510 | A * | 8/1981 | Kanno et al. | 271/127 |
| 4,385,335 | A * | 5/1983 | Kiemer | 360/137 |
| 4,905,046 | A * | 2/1990 | Tsunoi et al. | 399/18 |
| 6,089,562 | A * | 7/2000 | Jang et al. | 271/10.11 |
| 6,633,736 | B1 * | 10/2003 | Park | 399/66 |
| 2001/0012399 | A1 * | 8/2001 | Tohyama et al. | 382/167 |
| 2002/0054381 | A1 | 5/2002 | Iwase | |

FOREIGN PATENT DOCUMENTS

| | | |
|---|---|---|
| JP | A 61-237647 | 10/1986 |
| JP | 63074838 | 4/1988 |
| JP | B2 4-19028 | 3/1992 |
| JP | Y2 4-51444 | 12/1992 |
| JP | Y2 7-50354 | 11/1995 |
| JP | A 11-301080 | 11/1999 |
| JP | A 2001-106367 | 4/2001 |
| JP | A 2002-46312 | 2/2002 |
| JP | A 2002-60068 | 2/2002 |
| JP | 2002-128317 | 5/2002 |

* cited by examiner

*Primary Examiner*—Patrick H Mackey
*Assistant Examiner*—Thomas A Morrison
(74) *Attorney, Agent, or Firm*—Oliff & Berridge

(57) ABSTRACT

The paper feeding apparatus includes a manual feed tray, a spindle, a rotation lever, a cam, an operation shaft, a projection portion, an operation arm, and a stopper. The paper feeding apparatus is able to switch to/from automatic and manual paper feeds for stable loading of paper on the paper loading board and manual paper feed. The manual feed tray is openable/closable by turning around the spindle. The rotation lever and the cam are fixed on the operation shaft. When the manual feed tray is opened, the projection portion pushes the rotation lever. When the manual feed tray is closed, the cam touches the backside of the operation arm and the stopper rises. When the manual feed tray is opened, the rotation lever is pushed by the projection portion and the cam rotates in the clockwise direction separating from the backside of the operation arm. The stopper, consequently, is lowered.

21 Claims, 14 Drawing Sheets

PAPER FEEDING APPARATUS, IMAGE FORMATION APPARATUS WITH PAPER FEEDING APPARATUS AND STORAGE MEDIUM STORING CONTROL PROGRAM THEREOF

BACKGROUND OF THE INVENTION (1) Field of the Invention

This invention relates to a paper feeding apparatus for image formation apparatuses such as printers, facsimiles and copiers, an image formation apparatus with a paper feeding apparatus, and a storage medium storing control program thereof.

(2) Background Art

Paper feeding apparatuses are conventionally used in various apparatuses, e.g. printers and facsimiles, to feed paper from feed trays to image formation units.

Some of these paper feeding apparatuses are constituted to have a feed roller abutted on the uppermost sheet of paper loaded on a paper loading board, and to feed paper with the feed roller rolling toward the printing portion. These paper feeding apparatuses comprise a paper loading board obliquely placed to load sheets of paper, and an abutting surface obtusely arranged to the surface of the paper loading board in the lower part of the paper loading board abutting on the bottom end of the loaded sheets of paper (e.g. Unexamined Japanese Patent Publications No. 2002-60068 (FIG. 9) and No. 2001-106367 (FIG. 5)).

Since this abutting surface obtusely abuts the bottom end of the loaded sheets of paper, the bottom end of paper lacking elasticity tend to slip onto the abutting surface, and an influx of a pile of paper into downstream side of paper feed occurs. This does not allow a stable paper loading on a paper loading board.

It is preferable to arrange a stopper on the abutting surface making a right or an acute angle with sheets of paper loaded on the paper loading board. The bottom end of paper does not slip on the stopper. This can prevent an influx of a pile of paper going into downstream side of paper feed.

However, there has been a problem in arranging a stopper in a paper feeding apparatus constituted to feed paper sheet by sheet from a manual feed tray placed in the backside of a paper loading board in addition to an automatic feed to automatically feed paper loaded on the paper loading board sheet by sheet. The stopper interrupts a paper feed from a manual feed tray.

It is one of the objects of the present invention to provide a paper feeding apparatus with a switch-over between an automatic feed and a manual feed wherein a stable paper loading is allowed on a paper loading board, and a smooth manual feed is achievable, and to provide an image formation apparatus with this kind of paper feeding apparatus.

SUMMARY OF THE INVENTION

To attain this and other objects, the paper feeding apparatus of the present invention comprises a paper feed device constituted with a paper loading board to load paper obliquely, an abutting surface abutting the bottom end of loaded paper in the lower part of the paper loading board, a feed roller abutting on the surface of the loaded paper to send the paper to a predetermined direction sheet by sheet, and a manual feed tray openably/closably attached to the paper loading board to insert paper from the backside of the paper loading board onto the abutting surface, a stopper capable of vertical moves against the abutting surface to lift up the bottom end of the paper when the stopper is above the abutting surface, and a stopper drive device to lower the stopper below the abutting surface when the manual feed tray is open for paper insertion.

A paper feeding apparatus with above-described constitution can prevent an influx of a pile of paper going into downstream side of paper feed caused by the bottom end of paper slipping on the abutting surface since the stopper lifts up the bottom end of the paper loaded on the paper loading board. As the stopper is lowered when the manual feed tray is opened, the stopper does not interrupt an insertion of paper from the manual feed tray. Above-described paper feeding apparatus, hence, allows smooth automatic and manual paper feeds.

In order to lower the stopper when the manual feed tray is opened, the stopper driving device can be constituted to comprise a linking mechanism arranged between the manual feed tray and the stopper to lower the stopper when the manual feed tray is opened for a paper insertion.

A stopper of the paper feeding apparatus constituted as above does not interrupt an insertion of paper because the stopper is lowered by the linking mechanism when the manual feed tray is opened.

The above-mentioned stopper drive device comprises a rotational shaft facing to the stopper, a cam fixed on the rotational shaft, and a projection fixed on one end of the rotational shaft. The stopper comprises a stopper body abutting the bottom end of paper on the paper loading board, and an abutting unit extending from the stopper body and abutting on the cam to provide the stopper body with the vertical moves depending on the position of the cam. The manual feed tray is constituted to push the projection when it is opened for a paper insertion. The cam is constituted to move to the position it lowers the stopper body when the projection is pushed.

In a paper feeding apparatus constituted as above, when the manual feed tray is opened, it pushes the projection. The cam moves to the position to lower the stopper body and stopper lowers. Hence, the stopper lowers when the manual feed tray is opened, and does not interrupt an insertion of paper from the manual feed tray.

To lower the stopper when the manual feed tray is opened, the paper feeding apparatus can comprise a change detection device to detect changes in the state of the manual feed tray; if it is open or closed, and a control device constituted to allow the stopper drive device to lower the stopper when the change detection device detects that the state of the manual feed tray has changed from the closed state to the open state for a paper insertion.

In a paper feeding apparatus constituted as above, when the change detection device of the paper feeding apparatus detects a change in the state of manual feed tray from the close state to the open state capable of a paper insertion, and the control device allows the stopper drive device to lower the stopper. Therefore, when the manual feed tray is opened, the stopper lowers and the stopper does not interrupt a paper insertion.

When the manual feed tray is not open for a paper insertion, the stopper needs to be raised for a paper feed from the paper loading board.

For this purpose, the paper feeding apparatus may be constituted so that the stopper drive device raises the stopper when the change detection device detects a change in the state of the manual feed tray from the open state to the closed state.

With above-described constitution, when the change detection device detects a change in the state of the manual feed tray from the open state to the closed state, the stopper drive device raises the stopper. Thus when the manual feed tray is closed, the paper feeding apparatus can prevent an influx of pile of paper even when a lot of paper is loaded on the paper loading board.

In order to lower the stopper when the manual feed tray is opened, and raise the stopper when the manual feed tray is closed, the stopper drive device of above-described paper feeding apparatus further comprises a first gear fixed on one end of the rotational shaft, a second gear gearing with the first gear, and a rotational force transmission device to transmit rotational force gained from a driving source to the second gear. The control device is constituted to drive the driving source to move the cam to lower the stopper body when the manual feed tray is opened for a paper insertion, to raise the stopper body when the manual feed tray is closed.

With the paper feeding apparatus with above-described constitution, when the change detection device detects a change in the state of the manual feed tray from the closed state to the open state capable of a paper insertion, the control device drives the driving source to move the cam to lower the stopper body. The rotational force transmission device transmits the rotational force to the second gear. The rotational force is transmitted through the second gear to the first gear which rotates with the rotational shaft. Corresponding to the movement of the cam to lower the stopper body, the stopper lowers.

Adversely, when the change detection device detects a change in the state of the manual feed tray from the open state to the closed state, the control device drives the driving source to move the cam to raise the stopper body. The rotational force transmission device transmits the rotational force to the second gear. The rotational force is transmitted through the second gear to the first gear which rotates with the rotational shaft. Corresponding to the movement of the cam to raise the stopper body, the stopper rises.

The stopper, therefore, does not interrupt a paper insertion from the manual feed tray. The paper feeding apparatus can also prevent an influx of pile of paper even when a lot of paper is loaded on the paper loading board when the manual feed tray is closed.

The above-described paper feeding apparatus drives the driving source to lower the stopper, but there is a possibility of breakage of the stopper drive device caused by an extreme load on the stopper drive device with continuous driving of the driving source posterior to the lowering of the stopper.

To prevent this possibility of breakage, the paper feeding apparatus further comprises a rotation limit device which does not provide rotational force toward the direction of descent of the stopper to the first gear after the stopper lowers.

According to the paper feeding apparatus described above, rotational force is not provided toward the direction of descent of the stopper to the first gear after the stopper lowers. In other words, a breakage of the stopper drive device caused by unnecessary rotational force to the first gear can be avoided.

The image formation apparatus of the present invention comprises the paper feeding apparatus described above, an image formation device to form images on paper, a paper transfer device to transfer paper fed from the paper feeding apparatus to the image formation device, a paper detection device arranged in the paper transfer device to determine whether or not paper has been fed to the paper transfer device, and a feed control device. This feed control device drives the paper feeding apparatus to feed paper loaded on the paper loading board to the paper transfer device when a command to select an automatic paper feed is externally input to select a paper feed from the paper loading board. Subsequently, the feed control device drives the paper transfer device to transfer paper fed by the paper feeding apparatus to the image formation device when the paper detection device detects that paper has been fed. The feed control device furthermore drives the paper transfer device to transfer paper inserted from the manual feed tray to the image formation device when a command to select a manual paper feed is externally input to select a paper feed from the manual feed tray.

In an image formation apparatus constituted above, the stopper lifts up the bottom end of paper loaded on the paper loading board preventing an influx of pile of paper going into the downstream side of paper feed caused by the slipping of the bottom end of paper. When he manual feed tray is opened, the stopper lowers and does not interrupt a paper insertion. Therefore, favorable paper feeds can be achieved both automatically and manually.

The image formation apparatus furthermore comprises an opening/closing detection device to determine whether or not the manual feed tray is open for a paper insertion, a first annunciation device to forbid the process of the feed control device, and to announce the image formation apparatus is jammed with paper when the command to select an automatic paper feed is input, the opening/closing detection device detects the manual feed tray is not open, and the paper detection device detects the presence of paper.

In the image formation apparatus constituted as above, if the opening/closing detection device detects that the manual feed tray is not open, and if the paper detection device detects that paper has been fed at an input of a command to select the automatic paper feed, the first annunciation device forbids the process of the feed control device and announces that the image formation apparatus is jammed with paper. The ground for determining that the image formation apparatus is jammed with paper is that, in a normal operation, the presence of paper is not to be detected when a command to select the automatic paper feed is input. This can prevent the jam from becoming worse, and enable a user to know whether or not paper is jammed in the image formation apparatus.

The image formation apparatus also comprises a second annunciation device to announce a requirement for a paper insertion into the manual feed tray when an command to select a manual paper feed is externally input if the opening/closing detection device detects that the manual feed tray is open for a paper insertion and if the paper detection device detects the presence of paper.

With the constitution described above, when a command to select a manual paper feed is input, the second annunciation device announces a requirement a paper insertion into the manual feed tray if the opening/closing detection device detects that the manual feed tray is open for a paper insertion, and if the paper detection device detects the presence of paper.

This can remind a user to insert paper from the manual feed tray when feeding paper from the manual feed tray.

The image formation apparatus additionally comprises a command input device for feed initiation to input a command for feed initiation to initiate a paper feed from the manual feed tray, and a third annunciation device to announce a requirement for an input of a command for feed initiation when a command to select the manual paper feed is externally input if the opening/closing detection device detects that the manual feed tray is open for a paper insertion and if the paper detection device detects the presence of paper. The paper control device of the image formation apparatus is constituted to initiate a paper transfer with the paper transfer device when a user inputs a command for paper feed initiation using the command input device for feed initiation after an annunciation from the third annunciation device.

With the constitution described above, when a command to select a manual paper feed is input, if the opening/closing detection device detects that the manual feed tray is open for a paper insertion, and if the paper detection unit detects the presence of paper, the third annunciation device announces a requirement for an input of a command to initiate a paper feed. Subsequently, when a user inputs a command for a paper feed initiation using the command input device for a feed initiation, the paper feed control device initiates a paper transfer with the paper transfer device.

Hence, a paper transfer does not start immediately after a paper insertion from the manual feed tray. This can prevent a user inserting paper from the manual feed tray from getting startled.

The driving source of the image formation apparatus to drive the paper transfer device is constituted to be able to execute a predetermined preprocessing prior to image formation other than a paper transfer when driving the paper transfer device in the opposite direction to the direction of the paper transfer. The paper feed control device is constituted to drive the driving source in the opposite direction and execute the preprocessing when the change detection device detects that the state of the manual feed tray has changed from the closed state to the open state capable of a paper insertion.

In the image formation apparatus with this constitution, when the change detection device detects a change in the state of the manual feed tray from the closed state to the open state capable of a paper insertion, the paper feed control device drives the driving source in the opposite direction and executes the preprocessing.

Driving the drive source in the opposite direction to the paper transfer direction prior to a paper insertion from the manual feed tray can prevent the paper transfer device from misfeeding paper inserted into the manual feed tray.

The paper feeding apparatus control program of the present invention achieves functions of the change detection device and the control device of the paper feeding apparatus by computer processing.

A computer system controlled by the program described above can constitute some part of the paper feeding apparatus of the present invention, and achieve the same mechanism and effect.

The above-described control program also achieves functions of the paper detection device, opening/closing detection device and the first annunciation device of the image formation apparatus by computer processing.

The above-described control program furthermore achieves functions of the paper detection device, opening/closing detection device and the second annunciation device of the image formation apparatus by computer processing.

The above-described control program further achieves functions of the paper detection device, opening/closing detection device and the third annunciation device of the image formation apparatus by computer processing.

The above-described control program additionally achieves functions of the change detection device, the preprocessing execution device and the paper feed control device of the image formation apparatus by computer processing.

The above-described control program is provided to paper feeding apparatuses, image formation apparatus and users of these apparatuses through recording media, such as an FD and a CD-ROM, and a communication line network, for example Internet.

It is possible to use a computer system installed in a paper feeding apparatus or an image formation apparatus, or a computer system connected to a paper feeding apparatus or image formation apparatus capable of data communication through a communication path with/without a wire as a computer system to execute the control program described above.

BRIEF DESCRIPTION OF THE DRAWINGS

The image formation apparatus of the present invention will now be described below, by way of example an inkjet printer, with reference to the accompanying drawings.

DETAILIED DESCRIPTION OF THE PREFERRED EMBODIMENT

Figure 1:
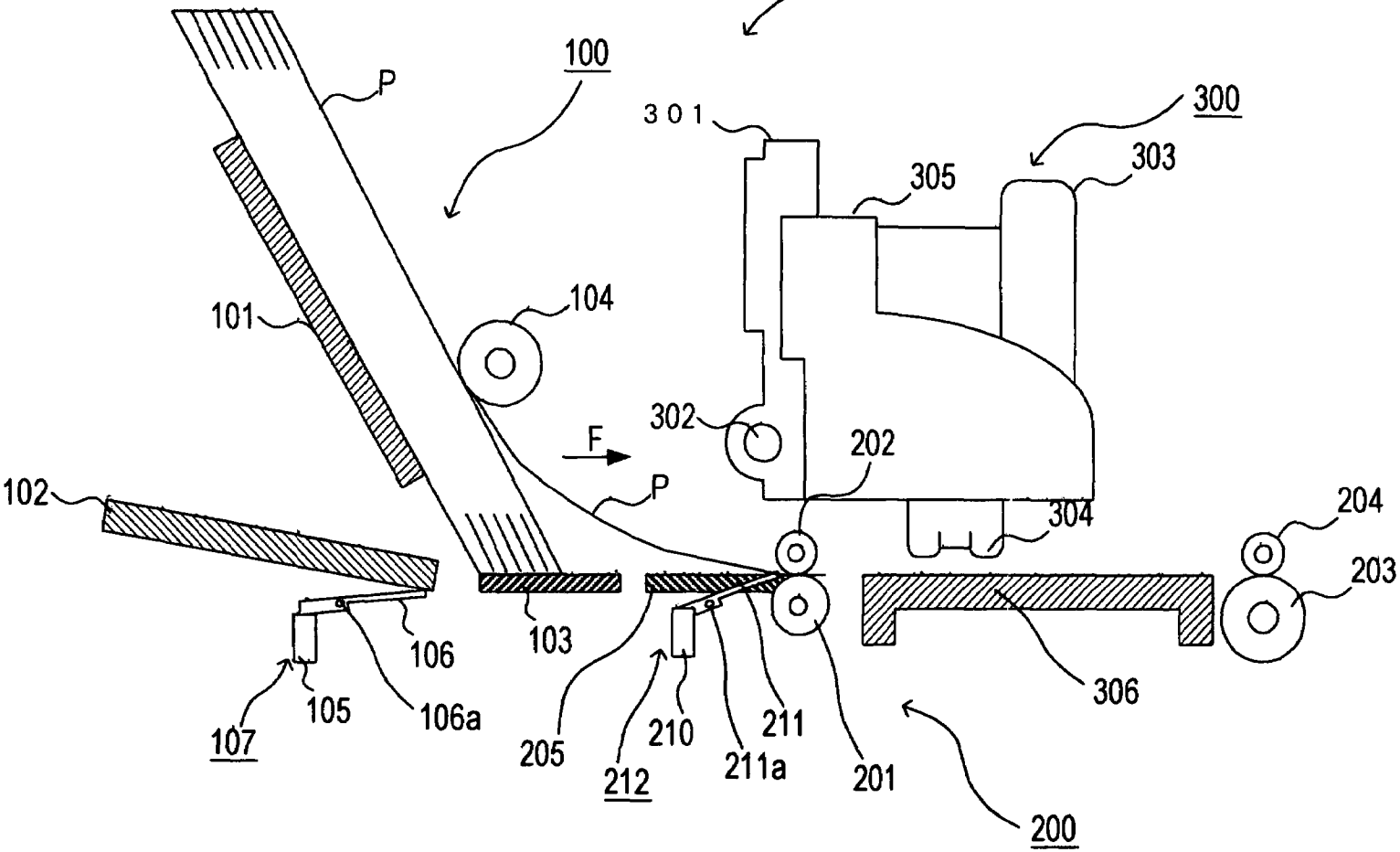
FIG. 1 is an explanatory view to show the structure of the inkjet printer of the embodiment according to the present invention.

Referring to FIG. 1, the structure of the inkjet printer 1 will now be explained.

An inkjet printer 1 comprises a paper feeding apparatus 100 which is capable of storing sheets of paper P and feed the paper sheet by sheet, a paper transfer mechanism 200 which transfers paper P fed by the paper feeding apparatus 100 to an discharge table (not shown in the drawing), a printing mechanism 300 which jets ink onto the paper P during transfer for printing (forming image), a transmission mechanism (not shown) which transmits driving force to rollers of the paper feeding apparatus 100 and the paper transfer mechanism 200, a control mechanism 400 to control respective operations of above-mentioned parts (refer to FIG. 3), and a body frame 2 (refer to FIG. 3) to support respective parts mentioned above.

The paper feeding apparatus 100 comprises a paper loading board 101 to load sheets of paper P obliquely, a manual feed tray 102 openably/closably attached to the paper loading board 101 to insert paper P sheet by sheet from the backside of the paper loading board 101, and a abutting surface 103 arranged in the lower part of the paper loading board 101 such that the bottom end of paper P is abutting hereto.

The paper feeding apparatus 100 also comprises a feed roller 104 extending to the horizontal direction (to the direction of the depth in FIG. 1) on the paper loading board 101. The both ends of the feed roller 104 are rotatably supported by sidewalls 112 (refer to FIG. 4). The feed roller 104 rotates by the driving force transmitted from a feed motor 220 (refer to FIG. 2) through the transmission mechanism (not shown).

The feed roller 104 abuts on the uppermost sheet of the paper P loaded on the paper loading board 101. When the feed roller 104 rotates in the counterclockwise direction in FIG. 1, only the uppermost sheet of the paper P abutting on the feed roller 104 is separated from others and fed in a paper transfer direction F toward the printing mechanisim 300 (rightward in FIG. 1).

The paper feeding apparatus 100 furthermore comprises a tray opening/closing sensor 107.

This tray opening/closing sensor 107 comprises a swing arm 106 biased to rotate by a spring (not shown) in the counterclockwise direction around an axis 106*a*, and a detection unit 105 which generates a turn-off signal when the swing arm 106 rotates in the counterclockwise direction and generates a turn-on signal when the swing arm 106 rotates in the clockwise direction.

The following explains the operation of the tray opening/closing sensor 107 when the manual feed tray 102 opens to permit a paper insertion.

When the manual feed tray 102 is closed and incapable of a paper insertion, the rotate unit 106 is activated to rotate in the counterclockwise direction, and the detection unit 105 is off.

When a user opens the manual feed tray 102, the bottom end of the manual feed tray 102 permits the swing arm 106 to rotate in the clockwise direction. By this clockwise rotation, the detection unit 105 turns on.

The tray opening/closing sensor 107 can detect the opening/closing of the manual feed tray 102 by being turned on when the manual feed tray 102 opens and turned off when the manual feed tray 102 is closed.

Now, the structure of the paper transfer mechanism 200 will be explained referring to FIG. 1.

The paper transfer mechanism 200 comprises a first transfer roller 201 rotatably supported by the body frame 2 in the upstream (the left side in FIG. 1) of a printing head 304, which is to be described later, of the printing mechanism 300. This first transfer roller 201 is driven by the driving force transmitted from a transmission mechanism in the clockwise direction in FIG. 1. A driven roller 202 abuts upon the first transfer roller 201.

The paper transfer mechanism 200 also comprises a second transfer roller 203 which is an ejection roller made of rubber rotatably supported by the body frame 2 in the down stream (the right side in FIG. 1) of the printing head 304. This second transfer roller 203 is driven by the driving force transmitted from the transmission mechanism in the ejection direction (the clockwise direction in FIG. 1). A driven roller 204 abuts upon the second transfer roller 203.

With the above-described constitution, paper P fed from the paper feeding apparatus 100 is transferred toward the transfer direction F accompanying with the rotations of the first and second transfer rollers 201 and 203.

The paper transfer mechanism 200 furthermore comprises a paper detection sensor 212 arranged slightly upstream of the printing head 304 to detect the presence/absence of paper P.

This paper detection sensor 212 comprises a swing arm 211 activated to rotate in the counterclockwise direction around an axis 211*a*, and a detection unit 210 which generates a turn-off signal when the swing arm 211 rotates in the counterclockwise direction and which generates a turn-on signal when the swing arm 210 rotates in the clockwise direction.

The following describes the operation of the paper detection sensor 212 when paper P passes by the paper detection sensor 212.

When paper P is not in the vicinity of the printing head 304, the swing arm 211 is biased to rotate in the counterclockwise direction by a spring (not shown), and its end (the right end in FIG. 1) is sticking out of a paper path 205. The detection unit 210 is, at this time, in the state of "Off".

When the paper P is transferred from the upstream, its leading end rotates the swing arm 211 in the clockwise direction, and the detection unit 210 turns on.

When the paper P is further advanced and the rear end of the paper P passes through the swing arm 211, the swing arm 211 is biased to rotate in the counterclockwise direction again, and the detection unit turns off.

The paper detection sensor 212 can detect the presence/absence of paper P by being turned on when paper P is in the vicinity and turned off when paper P is not there.

Referring to FIG. 1, the structure of the printing mechanism 300 is described below.

The printing mechanism 300 comprises a guide shaft 302 extending horizontally (in the direction of the depth in FIG. 1) and supported by the body frame 2, and a carriage 301, supported by the guide shaft 302, moves in a horizontal direction.

A cartridge holder 305 is fixed to the carriage 301. There is an ink cartridge 303, which contains ink used for printing, that is detachably attached to the cartridge holder 305.

A printing head 304 is attached to the carriage 301 and faces a platen 306, Which holds and horizontally supports paper P for printing. Plural ink jet nozzles (not shown in the drawing) are formed in the printing head 304 to jet ink supplied from the ink cartridge 303.

The carriage 301 can be reciprocated in a horizontal direction (the direction of the depth in FIG. 1) by the driving force transmitted from a carriage drive mechanism (not shown in the drawing). For printing, the ink jet nozzles selectively jet ink based on dot pattern data corresponding to the printing image with the carriage 301 (ink jet nozzles) reciprocating.

Figure 2:
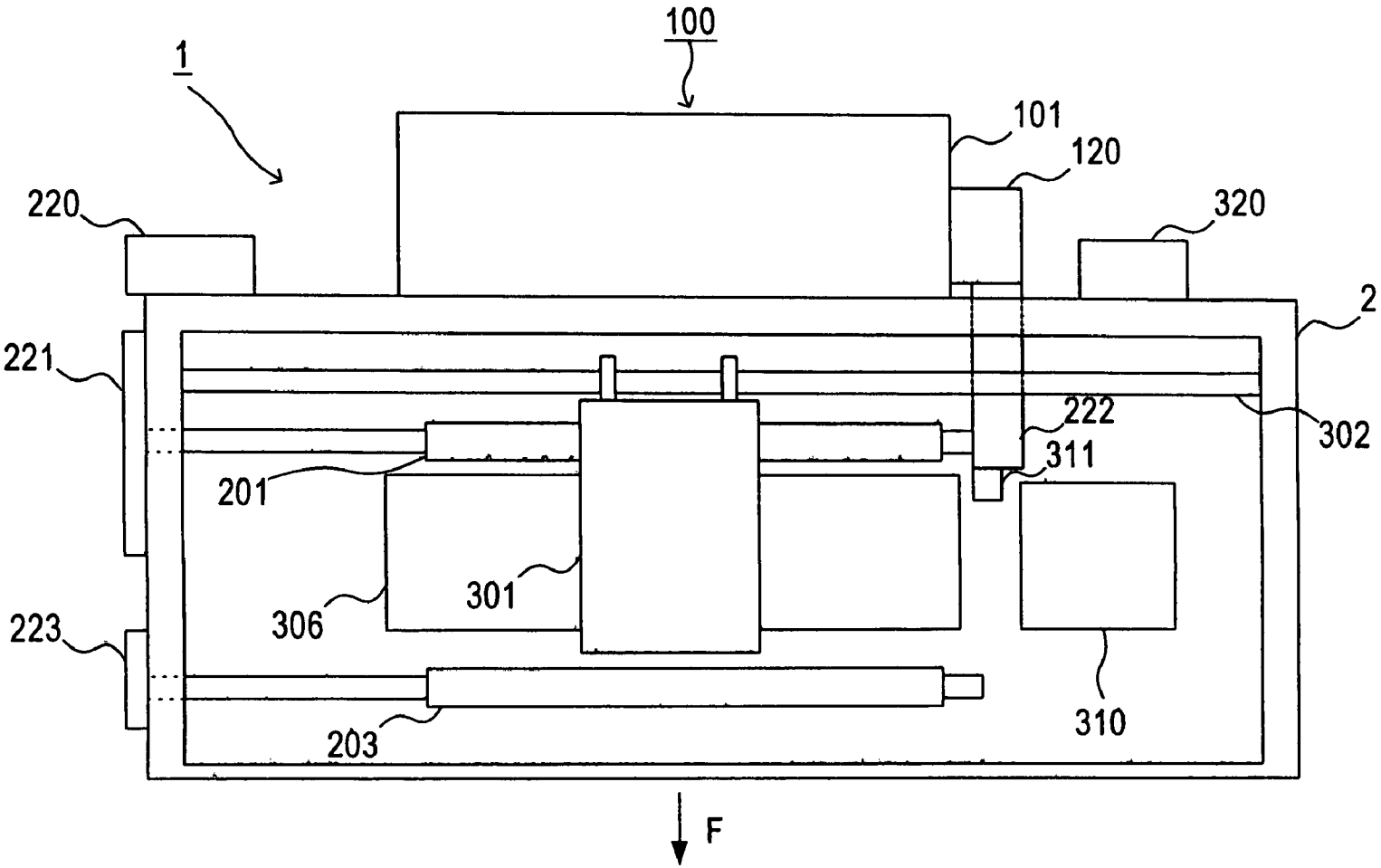
FIG. 2 is a schematic diagram to show the drive mechanism of the inkjet printer of the embodiment.

The following explanations are for the drive mechanism of the inkjet printer 1 based on FIG. 2. FIG. 2 shows a schematic diagram of the drive mechanism of the inkjet printer 1 viewed from above.

The inkjet printer 1 comprises a body frame 2 generally forming a rectangle box-shape.

To feed paper using the paper feeding apparatus 100, the feed motor 220 attached to the body frame 2 needs to be driven. The driving force used for this purpose is transmitted to the gear 221 fixed on the left end of the first transfer roller 201 through the transmission mechanism (not shown), and drives the first transfer roller 201.

On the right end of the first transfer roller 201, a driving mechanism 222 is attached. The driving force on the first transfer roller 201 is transmitted to a driving mechanism 120 attached to the paper feeding apparatus 100.

The driving force transmitted to the driving mechanism 120 is furthermore transmitted to the feed roller 104 by a transmission mechanism (not shown), and rotates the feed roller 104.

To transfer paper using the paper transfer mechanism 200, the feed motor 220 needs to be driven in the opposite direction to the direction the feed motor 220 is driven for a paper feed. The driving force used for paper transfer is transmitted to the gear 221 fixed on the left end of the first transfer roller 201 through the transmission mechanism (not shown), and drives the transfer roller 201.

The driving force is furthermore transmitted to the gear 223 fixed on the left end of the second transfer roller 203 through the transmission mechanism (not shown), and drives the second transfer roller 203.

To print (form an image) using the printing mechanism 300, a carriage motor 320 needs to be driven. The driving force used for this purpose is transmitted to the carriage 301 by the driving mechanism (not shown), and can reciprocate the carriage 301 horizontally guided by the guide shaft 302.

When printing is not executed, the carriage 301 is moved to the right side which is the outside of printing area and a cap 310 caps the printing head 304 so that the printing head 304 does not get dried. In this state, the carriage motor 320 gets deactivated and the carriage 301 is removed from the restriction. A carriage stopper 311 locks the carriage 301 so that the carriage 301 does not move from the position of the cap 310.

The carriage stopper 311 is placed in a lower position (in the direction of the depth in FIG. 2) than the position of the carriage 301, and constituted to be movable in the vertical direction.

When locking the carriage 301, the carriage stopper 311 rises to touch the left bottom edge of the carriage 301 and prevents the carriage 301 to move to the left side.

When unlocking the carriage 301, the carriage stopper 311 lowers separating from the left bottom edge of the carriage 301 and allows the carriage 301 to move to the left side.

In order to drive the carriage stopper 311 in the vertical direction (in the direction of depth in FIG. 2), the feed motor 220 needs to be driven. The driving force used for this purpose is transmitted to the gear 221 only when the carriage 301 is located on the cap 310. The driving force is transmitted to the gear 221 fixed on the left end of the first transfer roller 201 through the transmission mechanism (not shown) and drives the first transfer roller 201.

On the right end of the first transfer roller 201, the driving mechanism 222 is arranged. The driving force on the first transfer roller 201 is transmitted to the carriage stopper 311. In the present embodiment, it is arranged, provided the carriage 301 is on the cap 310, that the carriage stopper 311 rises when the first transfer roller 201 rotates in the transfer direction F, and it lowers when the transfer roller 201 rotates in the opposite direction to the transfer direction F.

The structure of the control mechanism 400 is explained below referring to FIG. 3.

Figure 3:
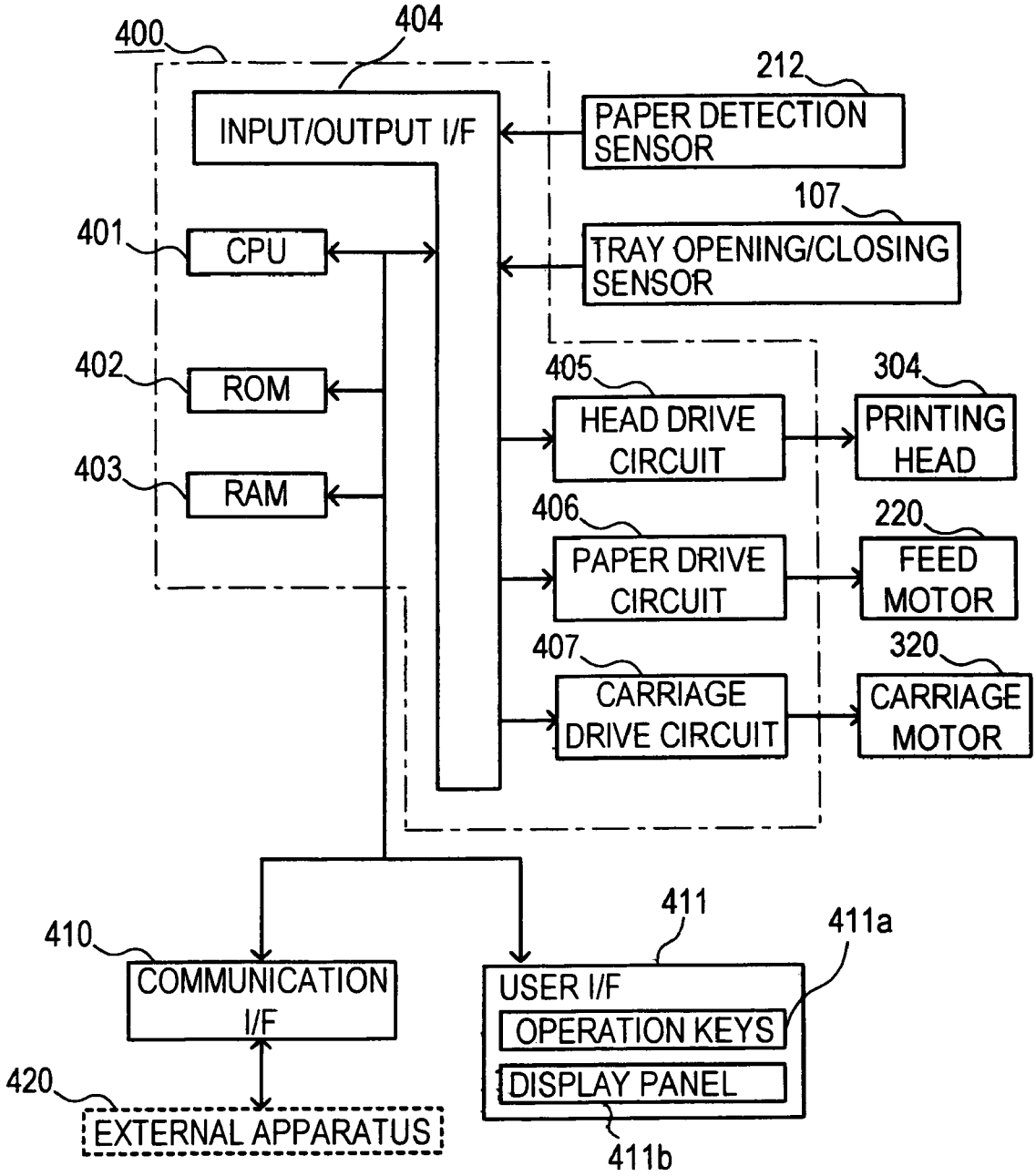
FIG. 3 is a block diagram to show the control system of the inkjet printer of the embodiment.

As shown in FIG. 3, the control mechanism 400 comprises a CPU 401, a ROM 402, a RAM 403, a head drive circuit 405, a paper drive circuit 406, a carriage drive circuit 407 and an input/output interface (referred as input/output I/F in below) 404 to connect these members.

The head drive circuit 405 is connected to the printing head 304 and transmits signals related to the driving in jetting ink.

The paper drive circuit 406 is connected to the feed motor 220 and transmits signals related to the driving of the feed motor 220. The feed motor 220 is constituted with, for example, a DC motor. The feed motor 220 drives the feed roller 104 of the paper feeding apparatus 100, the first and second rollers 201 and 203 of the paper transfer mechanism 200 through the transmission mechanism.

The carriage drive circuit 407 is connected to the carriage motor 320 and transmits signals related to driving of the carriage 301.

The input/output I/F 404 mutually connects above-mentioned members, and at the same time it is connected to the tray opening/closing sensor 107, the paper detection sensor 212, and also to an external apparatus 420 through a communication interface (referred as communication I/F in below) 410. The input/output I/F 404 comprises a user interface (referred as user I/F in below) 411 constituted with operation keys 411*a* on which a user can operate and a display panel 411*b* which displays various information.

The control mechanism 400 is capable of the same control as what a control mechanism does in a general inkjet printer. Description of this mechanism is not written here because it's not related to the present invention.

Figure 4:
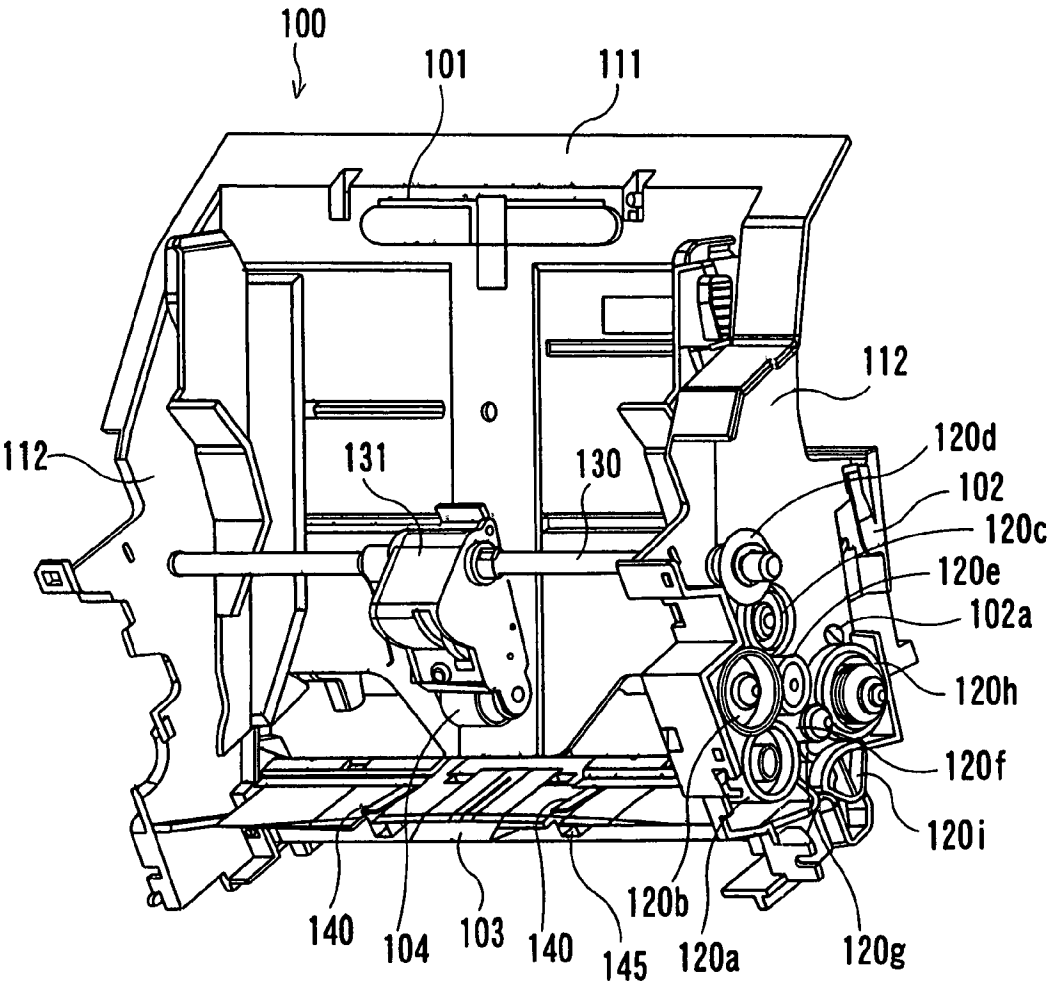
FIG. 4 is a perspective view of the paper feeding apparatus of the embodiment.
Figure 5:
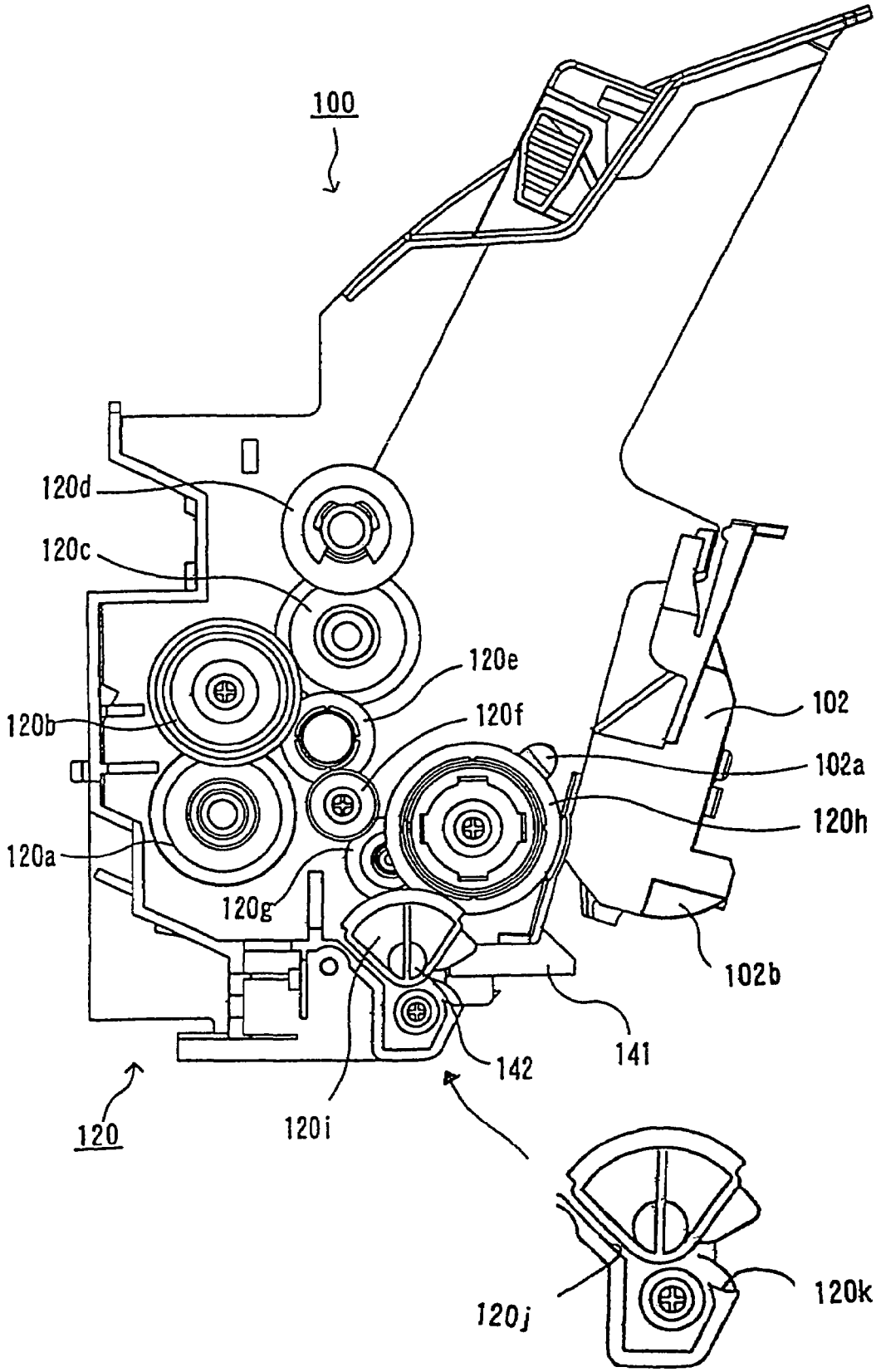

The movement of the paper feeding apparatus 100 is explained below referring to FIGS. 4 and 5. FIG. 4 illustrates a perspective view of the paper feeding apparatus 100. FIG. 5 shows a right side view thereof.

The paper feeding apparatus 100 comprises a frame 111, a paper loading board 101 to load sheets of paper P obliquely, a pair of sidewalls 112 arranged respectively on right and left sides of the paper loading board 101, a manual feed tray 102 openably/closably attached to the paper loading board 101 to insert paper P sheet by sheet from the backside of the paper loading board 101. The manual feed tray 102 can be opened/closed by turning around a spindle 102*a*.

The paper feeding apparatus 100 also comprises an abutting surface 103 to which the bottom end of paper P abuts in the lower part of the paper loading board 101 to guide the feeding of paper P to the printing mechanism 300.

Between the sidewalls 112 on both right and left sides, there is a transmission shaft 130 rotatably supported. A feed roller unit 131 having a feed roller 104 as a paper feed device is attached on the central part of this transmission shaft 130. The feed roller unit 131 comprises a transmission mechanism to transmit the driving force on the transmission shaft 130 to the feed roller 104.

On the external surface of the sidewall 112 on the right side in the drawing, a gear train which consists of gears 120*a*, 120*b*, 120*c*, 120*d*, 120*e*, 120*f*, 120*g*, 120*h*, 120*i* is arranged to transmit the force from the feed motor 220.

The feed roller unit 131 is constituted so that when the gear 120*d* makes regular rotations (rotates in the counterclockwise direction in FIGS. 4 and 5), the feed roller 104 makes reverse rotations (rotates in the clockwise direction in FIGS. 4 and 5). Only the uppermost sheet of paper P abutting the feed roller 104 is separated from other sheets of paper P on the paper loading board 101, and fed in the direction F toward the printing mechanism 300. The feed roller unit 131 is also constituted so that when the gear 120*d* makes reserve rotations (rotates in the clockwise direction), the driving force on the transmission shaft 130 is not transmitted to the feed roller 104, and the rotation of the feed roller 104 stops. Paper is not, therefore, fed.

The following describes a stopper 140 that prevents an influx of a pile of paper from going into the downstream side of the paper feed, which is caused by the bottom end of paper slipping on the abutting surface 103 when sheets of paper P are loaded on the paper feeding apparatus 100.

The stopper 140 is capable of vertically turning or swing within a location groove 145 formed along the feed direction on the abutting surface 103. When the stopper 140 lowers within the location groove 145, the stopper 140 does not abut the bottom end of paper P. On the other hand, when the stopper 140 rises and projects over the location groove 145, the stopper 140 lifts up the bottom end of paper P and abuts the bottom end of paper P at approximately a right angle.

Figure 6B:
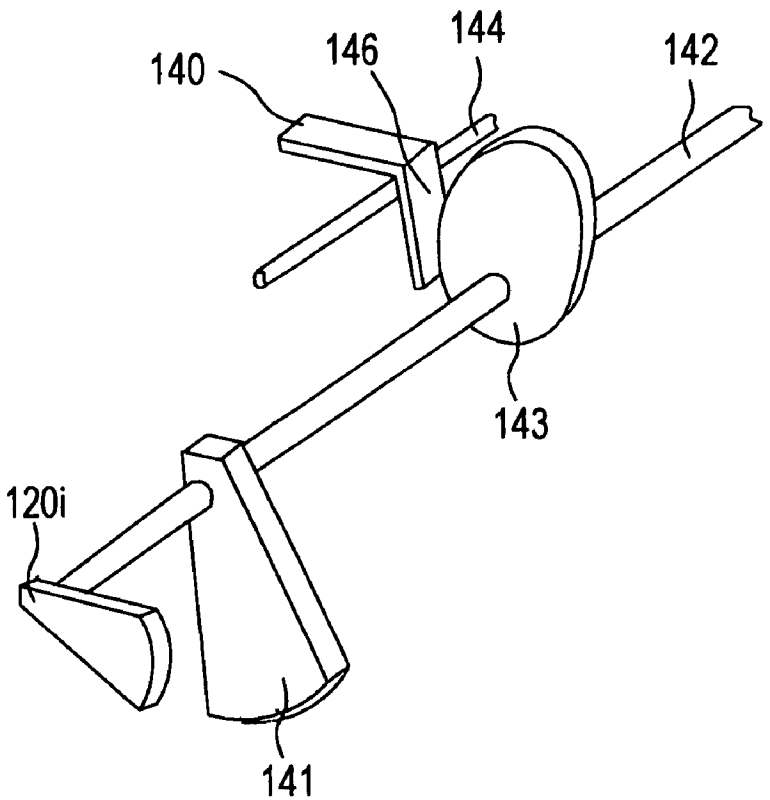
FIG. 6 is a side view of the paper feeding apparatus of the embodiment.
FIGS. 6A and B are an explanatory views to show the stopper of the embodiment in the raised and lowered state.
Figure 6A:
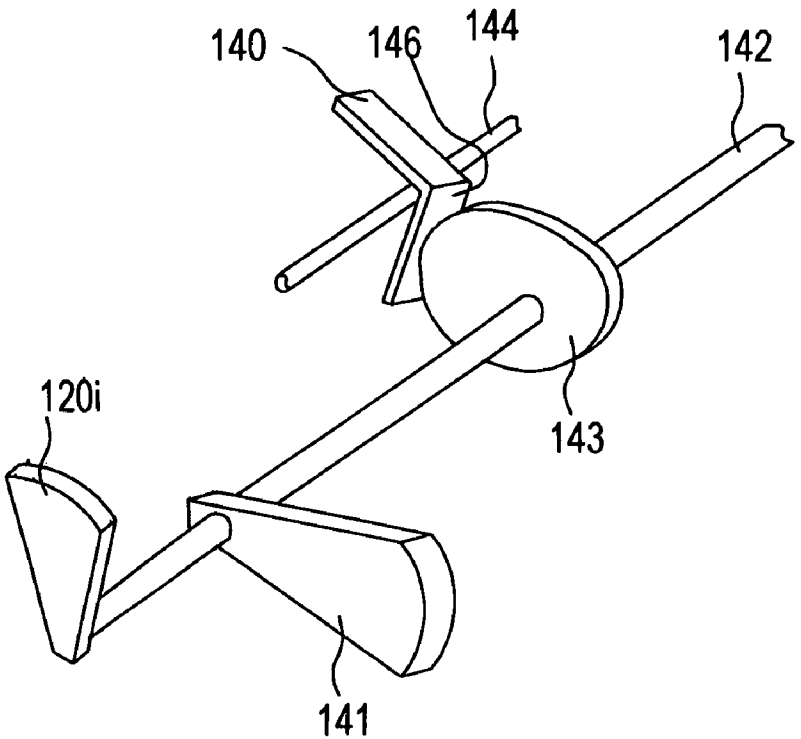

The driving mechanism that turns the stopper 140 in the vertical direction is described below referring to FIGS. 5, 6A, and 6B. FIGS. 6A and 6B are explanatory views that show the stopper 140 in raised/lowered state.

As shown in FIGS. 6A and B, the base of the elongated stopper 140 is fixed onto a spindle 144 rotatably supported by the frame 111 (refer to FIG. 4). There is an operation arm 146 extending downward from the base of the stopper 140.

An operation shaft 142 is rotatably arranged parallel to the rotatable spindle 144. On this operation shaft 142, a cam 143 is fixed at each point where an operation arm 146 is placed. The operation shaft 142 is rotatably supported by the sidewalls 112. The operation arm 146 is pressed against the cam 143 by a spring (not shown).

As FIG. 6A illustrates, the stopper 140 rises when the cam 143 rotates and pushes the backside of the operation arm 146. It is shown in FIG. 6B that the stopper 140 lowers when the cam 143 rotates and separates from the backside of the operation arm 146.

A rotation lever 141 and a gear 120*i* are fixed on the operation shaft 142 as shown in FIGS. 6A and B. Driving force is externally transmitted through either the rotation lever 141 or the gear 120*i*, and rotates the operation shaft 142.

Figure 7:
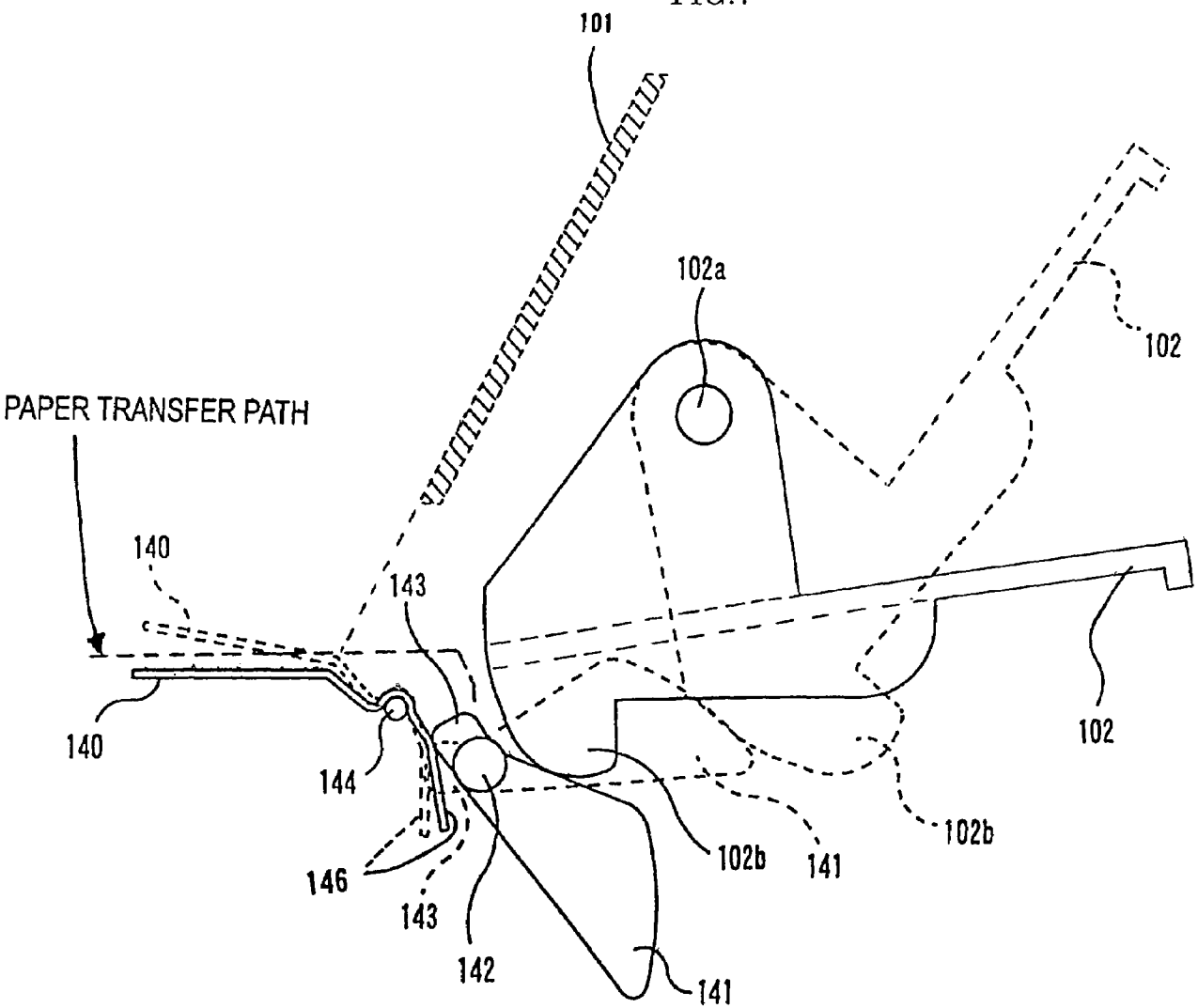
FIG. 7 is an explanatory view to show the stopper of the embodiment in the raised and lowered state.

The mechanism to transmit a driving force to the operation shaft 142 through the rotation lever 141 is explained below referring to FIG. 7. The manual feed tray 102 in solid lines indicates the open position (capable of a manual paper feed). The manual feed tray 102 in dashed lines shows the state of the manual feed tray 102 when it is opening from the closed state, and the state of a projection portion 102*b* and the rotation lever 141 are in contact.

The manual feed tray 102 can be opened/closed by turning around the spindle 102*a*. A projection portion 102*b* is arranged on the bottom end of the manual feed tray 102. This projection portion 102*b* pushes the rotation lever 141 when a user manually opens the manual feed tray 102.

When the manual feed tray 102 is closed, the projection portion 102*b* is away from the rotation lever 141 and does not affect the movement of the stopper 140.

When the manual feed tray 102 is opening from the closed state, the periphery surface of the cam 143 abuts the backside of the operation arm 146. When the manual feed tray is opened, the rotation lever 141 is pushed by the projection portion 102*b*. The cam 143 rotates in the clockwise direction separating the periphery surface away from the backside of the operation arm 146. The stopper 140, as a result, lowers (the state in full line in FIG. 7).

The mechanism to transmit the driving force to the operation shaft 142 through the gear 120*i* is explained below referring to FIGS. 5, 6A, and 6B. In this case, the vertical movement of the stopper 140 is not caused by opening/closing the manual feed tray l02 but, is caused by driving the feed motor 220.

As mentioned earlier, the driving force generated from the feed motor 220 is transmitted to the gear 120*a* through the gear 221, the first transfer roller 201, the driving mechanism 222 and so on.

When the gear 120*a* makes regular rotations (rotates in the clockwise direction in FIG. 5), the gear 120*b* which gears with the gear 120*a*, makes reverse rotations (rotates in the counterclockwise direction in FIG. 5), and the gear 120*e*, which gears with the gear 120*b* but not with the gear 120*c*, makes regular rotations.

The gear 120*f*, which gears with the gear 120*e*, makes reverse rotations, and the gear l20*g*, which gears with the gear 120*f*, makes regular rotations. The gear 120*h*, which gears with the gear 120*g*, makes reverse rotations, and the gear 120*i*, which gears with the gear 120*h*, makes regular rotations.

Consequently, the cam 143 rotates in the clockwise direction separating the periphery surface from the backside of the operation arm 146, as shown in FIG. 6B, and lowers the stopper 140.

Contrary, when the gear 120*a* makes reverse rotations, the gears 120*b*, 120*e*, 120*f*, 120*g*, 120*f* and 120*i* respectively rotate in the opposite direction to their rotation direction when the gear 120*a* makes regular rotations.

The cam 143, then, rotates in the counterclockwise direction pushing the backside of the operation arm 146 with the periphery surface as shown in FIG. 6A, and the stopper 140 rises.

Figure 8:
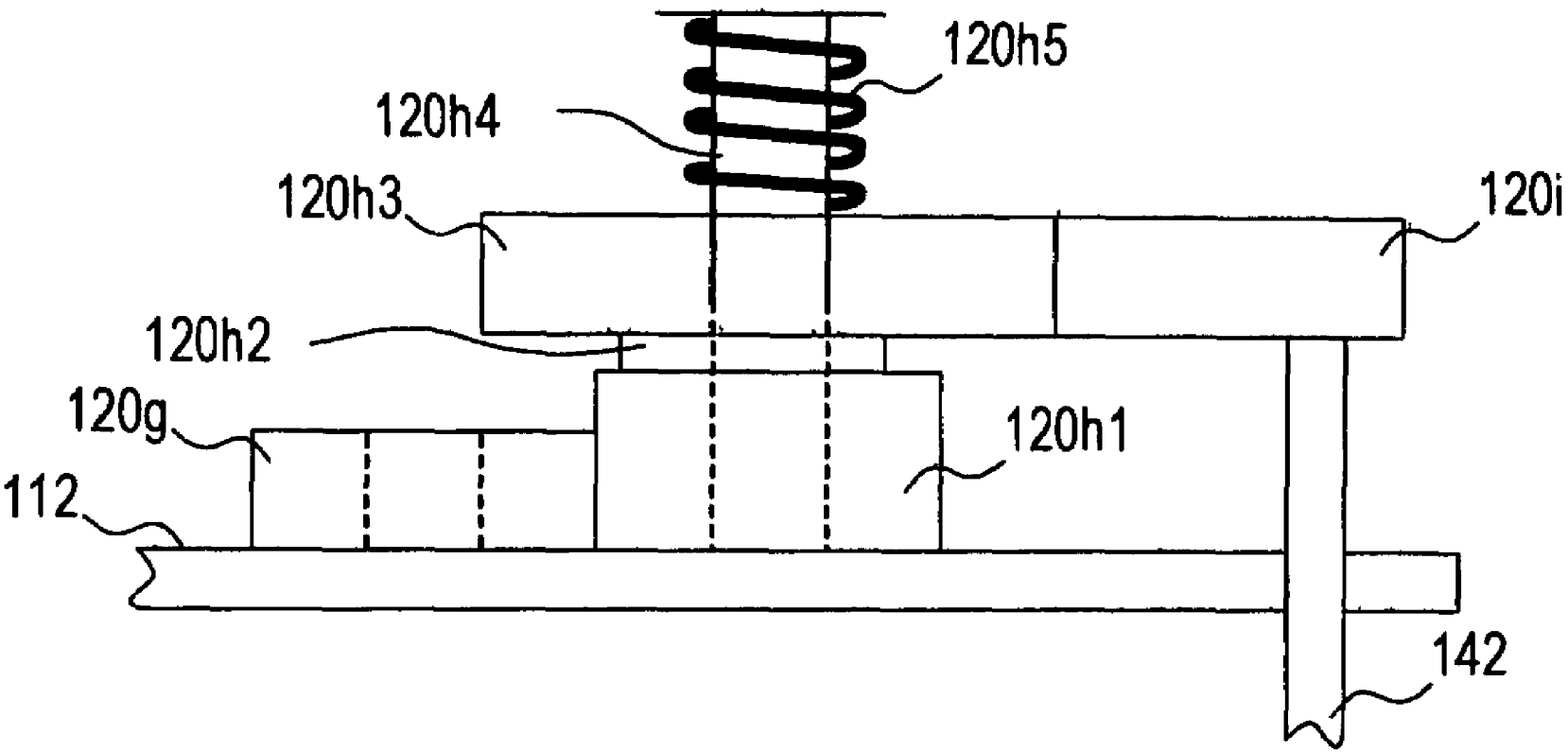
FIG. 8 is an explanatory view to show the structure of the gear of the embodiment.

The constitution of the gear 120*h* is illustrated in FIG. 8. The gear 120*h* comprises a gear 120*h*1 which gears with the gear 120*g*, a friction member 120*h*2 constituted, for example, with felt, a gear 120*h*3, which gears with the gear 120*i*, a support shaft 120*h*4 projecting through the centers of the gears 120*h*1 and 120*h*3, and a compression spring 120*h*5 pressing the upper surface of the gear 120*h*3. The gears 120*h*1 and 120*h*3 are configured to rotate freely around the support shaft 120*h*4.

Since the under surface of the gear 120*h*3 pressed by the compression spring 120*h*5 is in contact with the friction member 120*h*2, when there is no load on the gear 120*i*, the gears 120*h*1 and 120*h*3 rotate together by the frictional force of the friction member 120*h*2 and the gear 120*h*3.

When there is a load on gear 120*i*, a slip occurs between the friction member 120*h*2 and the gear 120*h*3. The driving force on gear 120*h*1 is not transmitted to gear 120*h*3, and gear 120*h*1 makes idle rotation.

Block walls 120*j* and 120*k* (refer to FIG. 5) are configured to stop the stopper 140 from turning further when the stopper 140 rises to the uppermost position and similarly, when the stopper 140 lowers to the lowermost position. When an increase in rotation is given to gear 120*i* and gear 120*i* is abutting one of the block walls 120*j* and 120*k*, gear 120*h* slips and does not transmit the driving force to gear 120*h*1. The driving force transmitted from gear 120*g* to gear 120*h*1 is not transmitted due to the idle rotation of gear 120*h*1.

In the followings, the movement of the stopper 140 during a paper feed is described based on FIG. 5.

When a printing is executed using sheets of paper P loaded on the paper loading board 101 of the paper feeding apparatus 100, the stopper is originally in the risen position lifting up the bottom end of paper P. Since the stopper 140 is in the risen position, influx of pile of paper P toward the first transfer roller 201 does not occur.

When a paper feed is initiated after a loading of sheets of paper P on the paper loading board 101, the feed motor 220 starts driving and the gear 120*a* makes regular rotations (rotates in the clockwise direction in FIG. 5). The gear 120*d*, thus, makes reverse rotations (rotates in the counterclockwise direction in FIG. 5). As described above, the driving force is transmitted to the feed roller 104 through the transmission shaft 130 and the paper roller unit 131, and gives the feed roller 104 regular rotation. Only the uppermost sheet of paper P abutting the feed roller 104 is fed in the direction F toward the printing mechanism 300.

At this time, the first transfer roller 201 rotates in the opposite direction to the rotational direction for advancing paper P in the direction F so that the first transfer roller 201 cannot transfer paper P to the printing mechanism 300 even though paper P is transferred to the first transfer roller 201 while a paper feed is executed. This movement is to correct diagonal transfer of paper P. It is not going to be described here since it is a well-known art.

When the gear 120*a* makes regular rotations, the cam 143 turns in the clockwise direction as described earlier. As the position of the cam 143 abutting to the operation arm 146 changes, the stopper 140 lowers.

Therefore, when a paper feed is initiated, the stopper 140 automatically lowers. The bottom end of loaded paper P abuts to the abutting surface 103. Loaded paper P can be fed sheet by sheet.

When paper P fed by the paper feeding apparatus 100 is transferred to the first transfer roller 201, the paper detection sensor 212 detects the transfer of paper P. After correcting a diagonal transfer of paper P as described above, the first transfer roller 201 rotates in the transfer direction F to transfer paper P, and paper P is transferred to the printing mechanism 300. Specifically, the drive direction of the feed motor 220 is opposite to the rotational direction for a paper feed.

The gear 120*a*, then, rotates in the opposite direction to the rotational direction for a paper feed. This gives the gear 120*d* reverse rotations. As a result, the rotation of the feed roller 104 stops as described above, and a paper feed is not carried out.

On the other hand, when the gear 120*a* makes reverse rotations, the cam 143 turns in the counterclockwise direction, as described earlier. The periphery surface of the cam 143 pushes the operation arm 146, and then the stopper 140 rises.

Specifically, when a paper feed is stopped and a paper transfer is initiated, the stopper 140 automatically rises and lifts up the bottom end of paper P.

Furthermore, after the printing mechanism 300 prints on paper P transferred by the paper transfer mechanism 200 and the paper is ejected, a paper feed is once again initiated to feed next sheet of paper P. When a paper feed is initiated, the gear 120*a* makes regular rotations again, and the stopper 140 lowers.

In case of feeding loaded paper P sheet by sheet, the ascent and descent of the stopper 140 are repeated at every feed.

In case of feeding paper from the manual feed tray 102, the manual feed tray 102 needs to be opened first. If there is paper P loaded on the paper loading board 101, the paper P should be removed, and then the manual feed tray can be opened. When the manual feed tray 102 is opened, the projection portion 120*b* pushes the rotation lever 141, the cam 143 turns in the clockwise direction, and the stopper 140 lowers.

A sheet of paper P is inserted from the manual feed tray 102 until the end of paper touches to the first transfer roller 201. By a press on a printing initiation button included in the operation keys 411*a*, the feed motor 220 starts driving, and the first transfer roller 201 transfers paper P in the transfer direction F.

Referring to FIGS. 9-12, the printing process executed by the CPU 401 according to the program in the ROM 402 is explained below.

Figure 9:
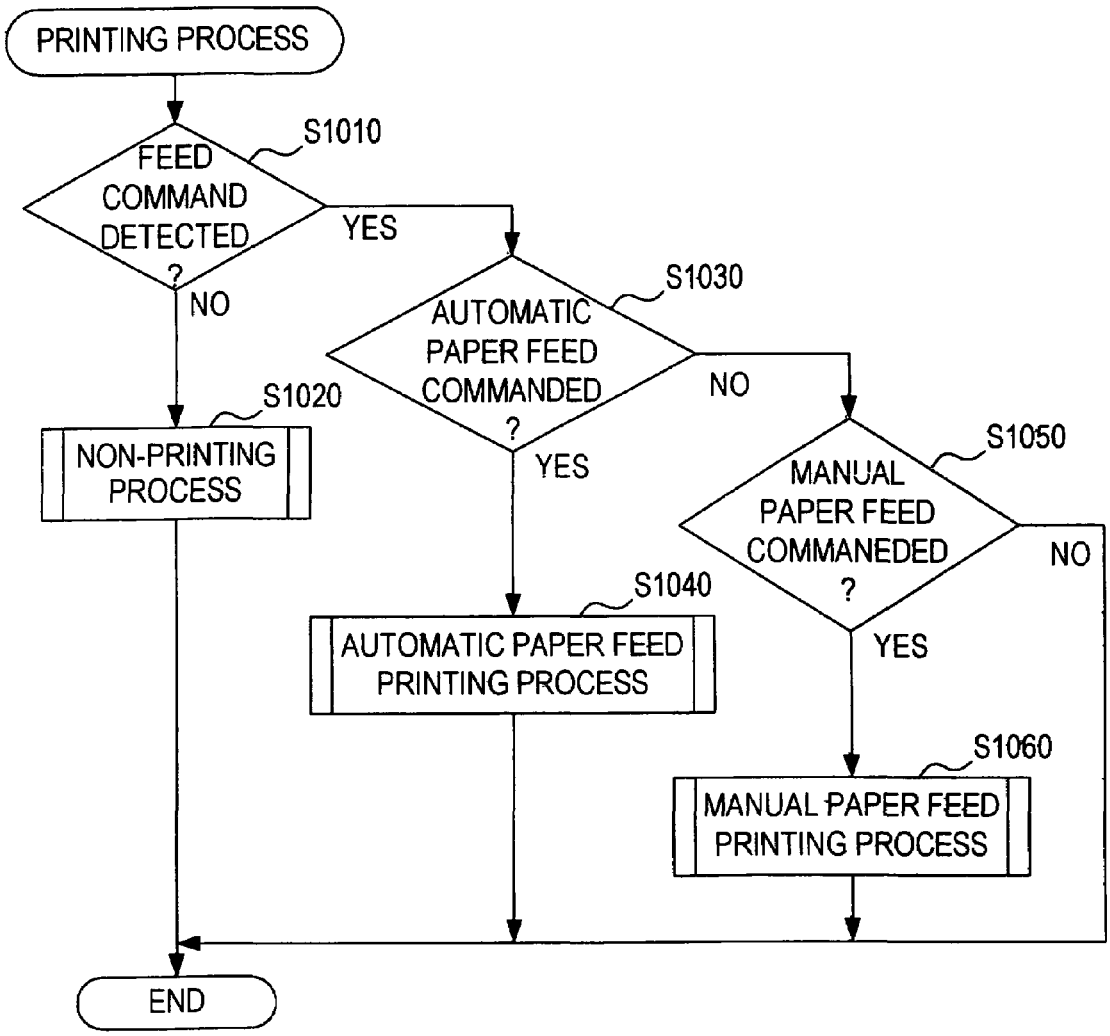
FIG. 9 is a flowchart to show the procedure of the printing process of the embodiment.

FIG. 9 is a flowchart illustrating the printing process.

This process is executed repeatedly while the inkjet printer 1 is activated (the power is on).

When this printing process is executed, the control mechanism 400 first determines whether or not it detects a paper feed command in S1010. This paper feed command is input either from the external apparatus 420 through the communication I/F 410 or from the operation keys 411*a* through the user I/F 411.

When the control mechanism 400 determines that it does not detect a paper feed command (S1010: NO), the process goes to S1020, and the control mechanism 400 executes a non-printing process. After the non-printing process is completed, the printing process is terminated.

Figure 10:
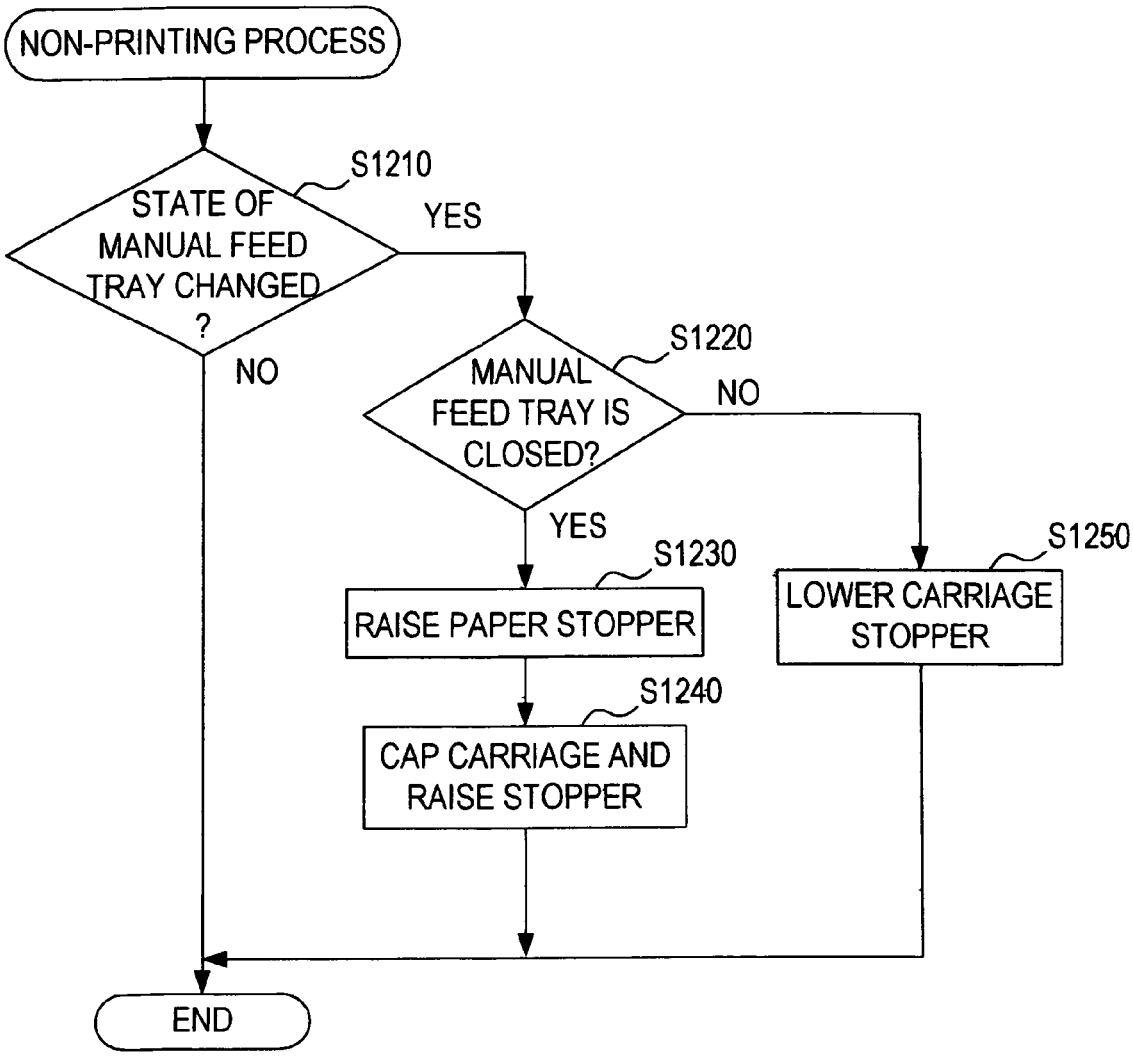
FIG. 10 is a flowchart to show the procedure of the non printing process of the embodiment.

This non-printing process is executed following the process illustrated in FIG. 10. In S1210 of the non-printing process, the control mechanism 400 determines whether or not there is any change of the manual feed tray 102 in the open/closed state by a change in the on/off state of the tray opening/closing sensor 107.

When the control mechanism 400 determines that the open/closed state of the manual feed tray 102 has not changed (S1210: NO), the non-printing process is terminated.

When the open/closed state of the manual feed tray 102 changes, i.e. the control mechanism 400 determines that the output of the tray opening/closing sensor 107 has changed from ON to OFF, or from OFF to ON (S1210: YES), the process goes to S1220, and the control mechanism 400 determines whether or not the manual feed tray 102 is closed by the ON/OFF state detected by the tray opening/closing sensor 107.

In S1220, when the control mechanism 400 determines that the manual feed tray 102 is open (S1220: YES), the process goes to S1230, and the process to raise the stopper 140 is executed (S1230). Subsequently, the carriage 301 is moved to the position of the cap 310, the processes to cap the carriage 301 and to raise the carriage stopper 311 are executed (S1240). After these processes, the non-printing process is terminated.

In S1220, when the control mechanism 400 determines that the manual feed tray 102 is open (S1220: NO), the process goes to S1250, and a process to lower the carriage stopper 311 (S1250) is executed. After the carriage 301 becomes movable, the non-printing process is terminated.

In S1010 of FIG. 9, when the control mechanism 400 determines that it has detected a paper feed command (S1010: YES), the process goes to S1030, and the control mechanism 400 determines whether or not the paper feed command is for an automatic paper feed. When the control mechanism 400 determines that the command is for an automatic paper feed (S1030: YES), the process goes to S1040, and an automatic paper feed printing process is executed. When this automatic paper feed printing process is completed, the printing process is terminated.

Figure 11:
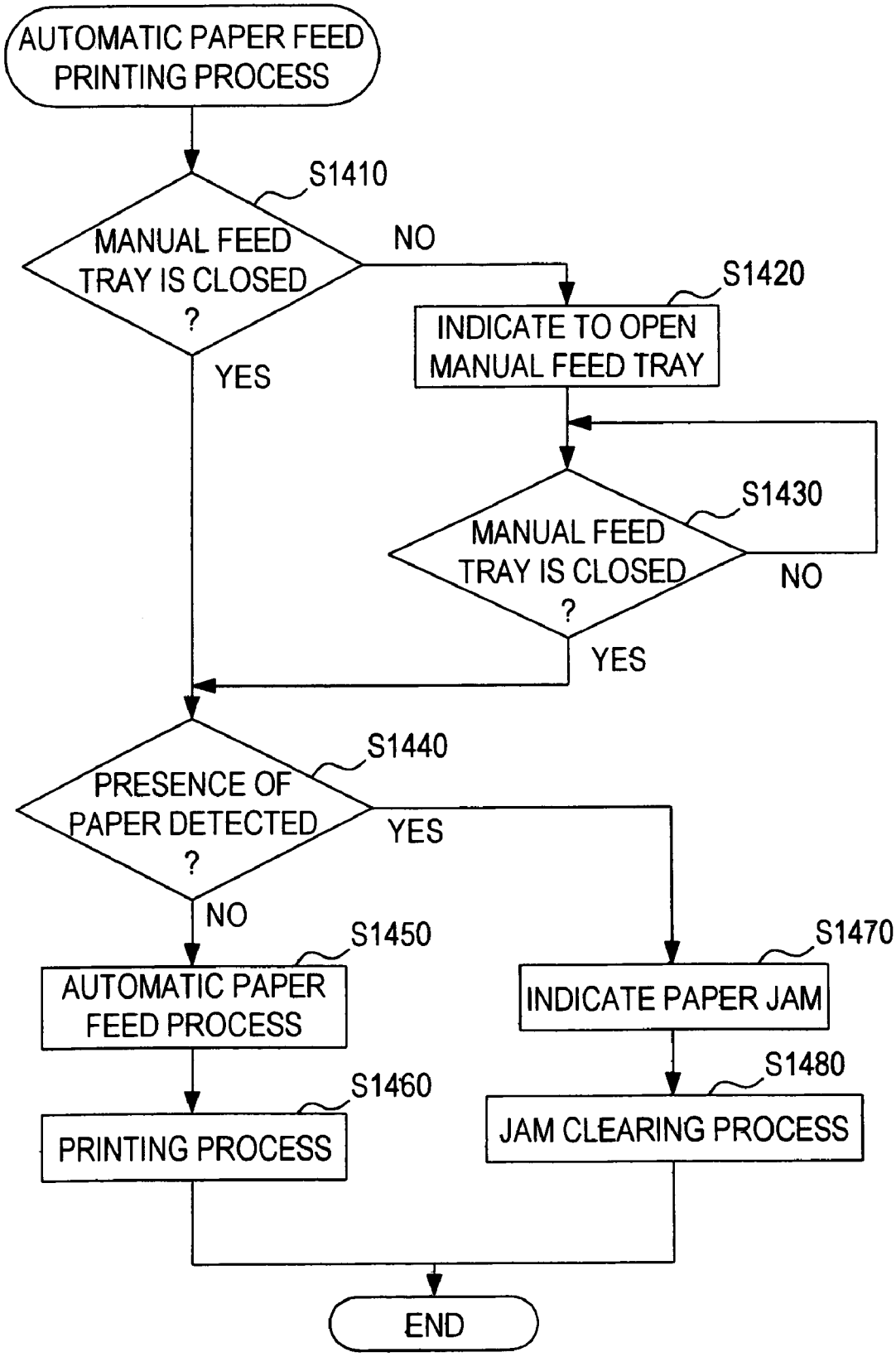
FIG. 11 is a flowchart to show the procedure of the automatic paper feed printing process of the embodiment.

This automatic paper feed printing process is executed following the process illustrated in FIG. 11. In S1410 of the automatic paper feed printing process, the control mechanism 400 determines whether or not the manual feed tray 102 is closed.

When the control mechanism 400 determines that the manual feed tray 102 is closed (S1410: YES), the process goes to S1440.

When the control mechanism 400 determines that the manual feed tray 102 is not closed (Sl410: NO), the process goes to S1420, and a process to indicate that the manual feed tray 102 is open is executed. This process is done by indicating that the manual feed tray 102 is open on the display panel 411*b*. An indication of "Close the manual feed tray" can be shown alone or in addition to the display on the display panel 411*b*.

After the process to indicate that the manual feed tray 102 is open is over, the process goes to S1430, and the control mechanism 400 determines whether or not the manual feed tray 102 is closed. When it is determined that the manual feed tray 102 is closed (S1430: YES), the process goes to S1440. When it is determined that the manual feed tray 102 is not closed (S1430: NO), the process in S1430 is repeated.

In S1440, the control mechanism 400 determines whether or not the presence of paper P is detected by the ON/OFF state of the paper detection sensor 212. When it is determined that the presence of paper P is not detected (S1440: NO), the process goes to S1450 to drive the feed roller 104 and execute the automatic paper feed process wherein a sheet of paper is fed from the paper P loaded on the paper loading board 101. After the automatic paper feed process is over, the process goes to S1460 to transfer paper P by the paper transfer mechanism 200, and to execute a printing process done by the printing mechanism 300. After the printing process is completed, the automatic paper feed printing process is terminated.

In S1440, if it is determined that the presence of paper P is detected (S1440: YES), paper P is determined to be jammed since paper P stays inside of the inkjet printer 1 despite the manual feed tray 102 that is closed at the initiation of automatic paper feed. The ground for determining that paper P is jammed is that, in a normal operation, the presence of paper P is not to be detected. In this case, the process goes to S 1470 to execute a process for indicating a paper jam. This process is done by indicating that paper P is jammed in the inkjet printer 1 on the display panel 411*b*. After a user executes a process to remove jammed paper P in the inkjet printer 1 (S1480), the automatic paper feed printing process is terminated.

In S1030 of the printing process in FIG. 9, when it is determined that the command is not for an automatic paper feed (S1030: NO), the process goes to S1050, and the control mechanism 400 determines whether or not the paper feed command is for a manual paper feed. When it is determined that the command is for a manual paper feed (S1050: YES), the process goes to S1060 to execute the manual paper feed printing process. After the manual paper feed printing process is completed, the printing process is terminated.

Figure 12:
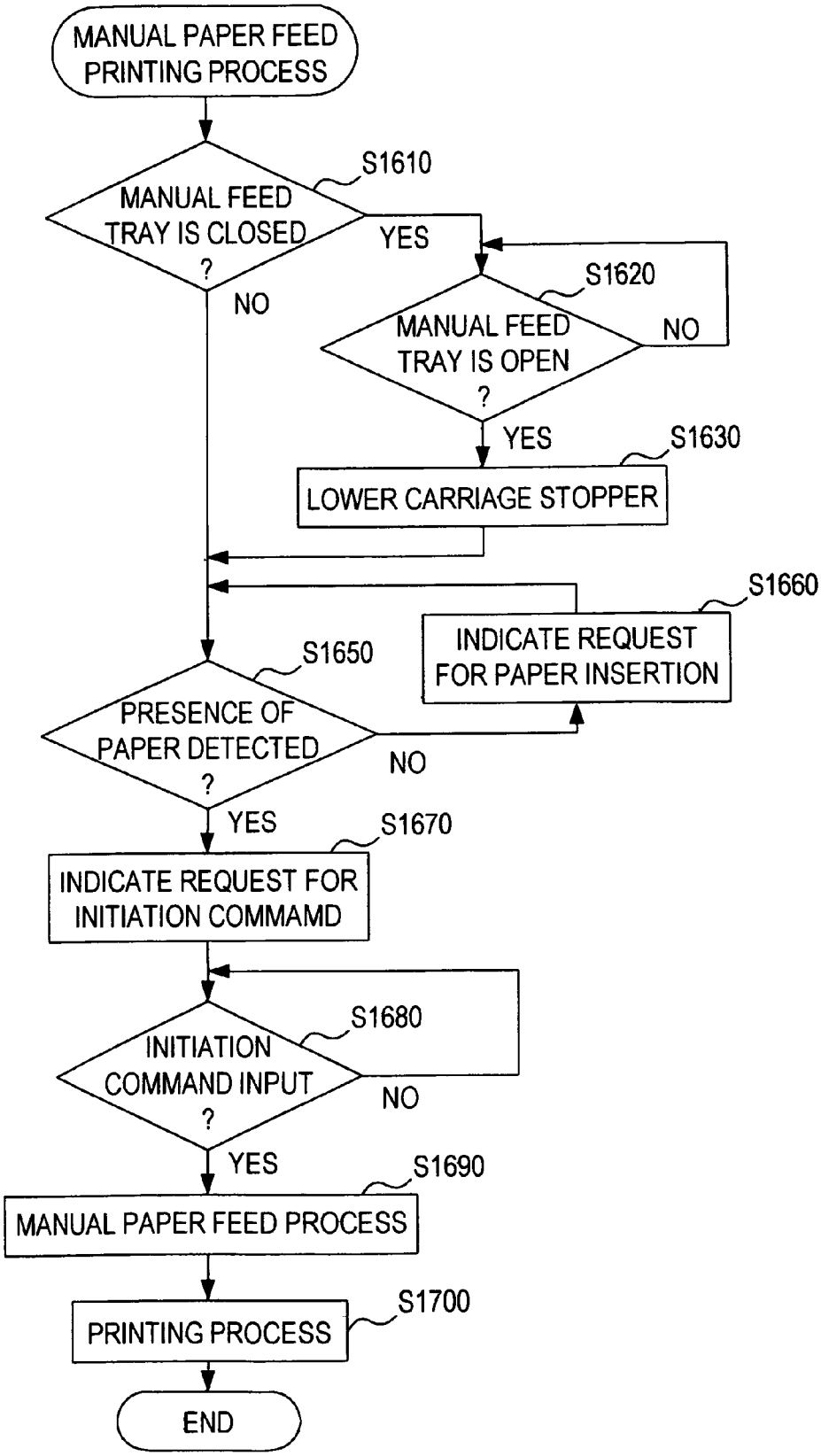
FIG. 12 is a flowchart to show the procedure of the manual paper feed printing process of the embodiment.

This manual paper feed printing process is executed following the process illustrated in FIG. 12. In S1610 of the manual paper feed printing process, the control mechanism 400 determines whether or not the manual feed tray 102 is closed.

When it is determined that the manual feed tray 102 is not closed (S1610: NO), the process goes to S1650.

When it is determined that the manual feed tray 102 is closed (S1610: YES), the process goes to S1620, and the control mechanism 400 determines whether or not the manual feed tray 102 is open.

When it is determined that the manual feed tray 102 is not open (S1620: NO), the process of S1620 is once again executed to wait for the manual feed tray 102 to be open. An indication of "Open the manual feed tray" can be shown on the display panel 411*b*. When a user opens the manual feed tray 102, the stopper 140 is accommodated in the location groove 146, and move to the position lower than the position of the abutting surface 103.

When it is determined that the manual feed tray 102 is open (S1620: YES), the process goes to S1630 to execute the process to lower the carriage stopper 311. Then the process goes to S 1650.

In S1650, the control mechanism 400 determines whether or not the presence of paper P is detected. When it is determined that the presence of paper P is not detected (S1650: NO), the process goes to S1660 to execute a process to display a requirement for paper insertion. This process is done by indicating on the display panel 411*b* that an insertion of paper P from the manual feed tray 102 is required. The process in S 1650 is executed again to wait for paper P to be transferred.

In S1650, when it is determined that the presence of paper P is detected (S1650: YES), the process goes to S1670 to execute a process to display a requirement for initiation command. This process is done, for example, by indicating on the display panel 411*b* that an input of printing initiation command by the operation keys 411*a* is required. Subsequently, the process goes to S1680, and the control mechanism 400 determines whether or not the printing initiation command has been input. When it is determined that the printing initiation command has not been input (S1680: NO), the process goes to S1680 to determine whether or not the printing initiation command has been input.

When it is determined that the printing initiation command has been input (S1680: YES), the process goes to S1690 to execute a manual paper feed wherein the first transfer roller 201 is driven to feed paper P. As described above, even when the paper detection sensor 212 is turned on in S1650, the first transfer roller 201 is not driven until it is determined in S1680 that the printing initiation command has been input. After the manual paper feed is completed, the process goes to S1700 to execute the printing process to transfer paper P by the paper transfer mechanism 200 and to print by the printing mechanism 300. After the printing process is completed, the manual paper feed printing process is terminated.

In S1050 of the printing process in FIG. 9, when it is determined that the command is not for a manual paper feed (S1050: NO), the printing process is terminated.

[Effect]

With the inkjet printer 1 constituted as above, when the manual feed tray 102 opens, the projection portion 102*b* pushes the rotation lever 141. When the rotation lever 141 is pushed, the cam 143 moves to the position to lower the stopper 140, and then the stopper 140 lowers. In other words, when the manual feed tray 102 opens, the stopper 140 lowers and does not interrupt insertion of paper P from the manual feed tray 102.

When it is detected that the state of the manual feed tray 102 has changed from the closed state to the open to permit a paper insertion by the processes of S1210 to S1220 in FIG. 10, the control mechanism 400 drive the feed motor 220 so that the cam 143 moves to the position to lower the stopper 140. The rotational force is transmitted through the gears 120*a*, 120*b*, 120*e*, 120*f* and 120*g* to the gear 120*h*. The rotational force is, then, transmitted through the gear 120*h* to the gear 120*i* which rotates with the operation shaft 142. By the movement of the cam 143 to the position to lower the stopper 140, the stopper 140 lowers.

Therefore, when paper is inserted from the manual feed tray 102, the stopper 140 does not interrupt the insertion of paper P.

When there is a load on gear 120*i*, a slip occurs between friction member 120*h*2 and gear 120*h*3. The driving force of gear 120*h*1 is not transmitted to gear 120*h*3, and gear 120*h*1 makes idle rotation. Gear 120*h* does not provide rotational force to gear 120*i* in the descent direction of the stopper 140 after the stopper 140 is lowered.

This can prevent a breakage on a linking mechanism arranged between the feed motor 220 and the stopper 140 by giving 120*i* over-rotation.

When it is determined that the command to select an automatic paper feed has been input in the process of S1030 in FIG. 9, if it is detected in the process of S1410 in FIG. 11 that the manual feed tray 102 is not open for a paper insertion, and if it is detected in the process of S1440 in FIG. 11 that paper P has been transferred, it is announced in the process of S1470 in FIG. 11 that paper P is jammed in the inkjet printer 1.

This can tell a user of the inkjet printer 1 whether or not paper P is jammed in the inkjet printer 1.

When it is determined that the command for a manual paper feed has been input in the process of S1050 in FIG. 9, if it is detected in the process of S1610 that the manual feed tray 102 is open for a paper insertion, and if the presence of paper is not detected in the process of S1650 in FIG. 12, a requirement for a paper insertion from the manual feed tray 102 is announced in the process of S1660 in FIG. 12.

This can prevent a user from forgetting to insert paper P from the manual feed tray 102 when using the paper feed from the manual feed tray 102. The paper detection sensor on the manual feed tray 102 can also work as a jam detection sensor.

When it is determined that the command for manual paper feed has been input by the process of S1050 in FIG. 9, if the manual feed tray 102 is detected to be open for a paper insertion, and if the presence of paper P is detected in the process of S1650, a requirement to input the printing initiation command from, for example, operation keys 411*a* is displayed on the display panel 411*b* in the process of S1670 in FIG. 12. Subsequently, when it is determined that the printing initiation command has been input in the process of S1680 in FIG. 12, the paper transfer mechanism 200 initiates a paper transfer in the process of S1690 in FIG. 12. This can prevent a user inserting paper P from the manual feed tray 102 from getting startled by a immediate initiation of a paper transfer because when feeding paper from the manual feed tray 102, the transfer of paper P does not get started immediately after an insertion of paper from the manual feed tray 102.

When it is detected that the state of the manual feed tray 102 has changed from the closed state to the open state capable of a paper insertion in S1210 to S1220 of FIG. 10 or in S1610 to S1620 of FIG. 12, the feed motor 220 drives in the opposite direction to the direction of paper transfer in S1250 in FIG. 10 or in S1630 of FIG. 12 to lower the carriage stopper 311. Specifically, the process to drive the feed motor 220 in the opposite direction to the direction of paper transfer is executed before paper P is inserted into the manual feed tray 102.

As a result of rotation of the first transfer roller in the opposite direction to the direction of paper transfer after an insertion of paper P from the manual feed tray 102 until one end of the paper P touches the first transfer roller 201, the end of paper P does not touch the first transfer roller 201. This prevents a misfeed wherein the first transfer roller 201 does not transfer paper P even when the first transfer roller 201 rotates in the direction paper transfer in order to transfer paper P to the direction of paper transfer.

[Variation]

The present invention is not limited to the above embodiment. There are other possible modifications and variations with in the scope of the present invention, and some of them are explained in the following sections.

The above embodiment shows an example in applying the constitution of the image formation apparatus of the present invention to the inkjet printer 1. The constitution of the image formation apparatus of the present invention can be applied to other apparatuses, as long as they have functions as image formation apparatuses.

In the above embodiment, the processes of FIGS. 9 to 12 are executed by the computer systems constituted of the control mechanism 400 with the inkjet printer 1. These processes, however, can be executed by another computer systems connected to the inkjet printer 1 by a signal transmission path with/without a wire.

Figure 13:
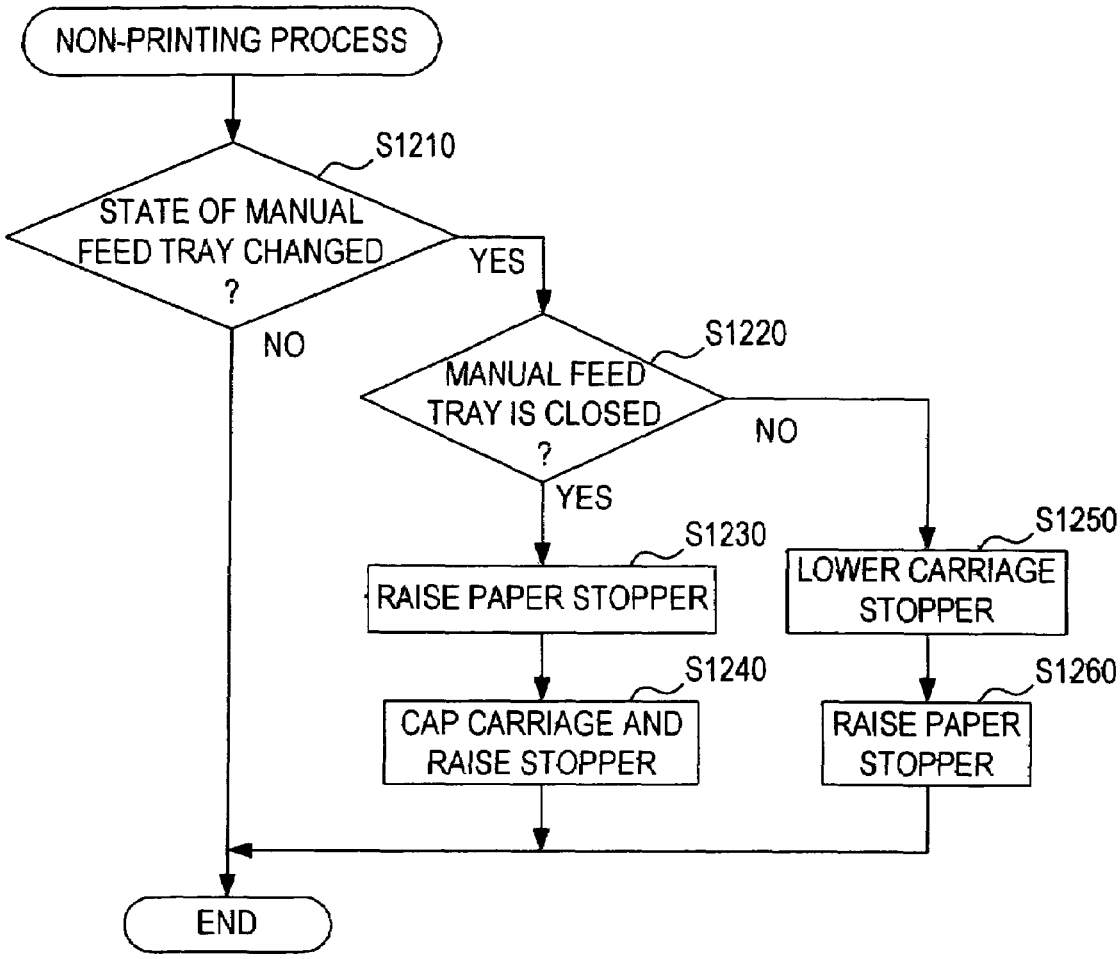
FIG. 13 is a flowchart to show the procedure of the non-printing process of another embodiment.
Figure 14:
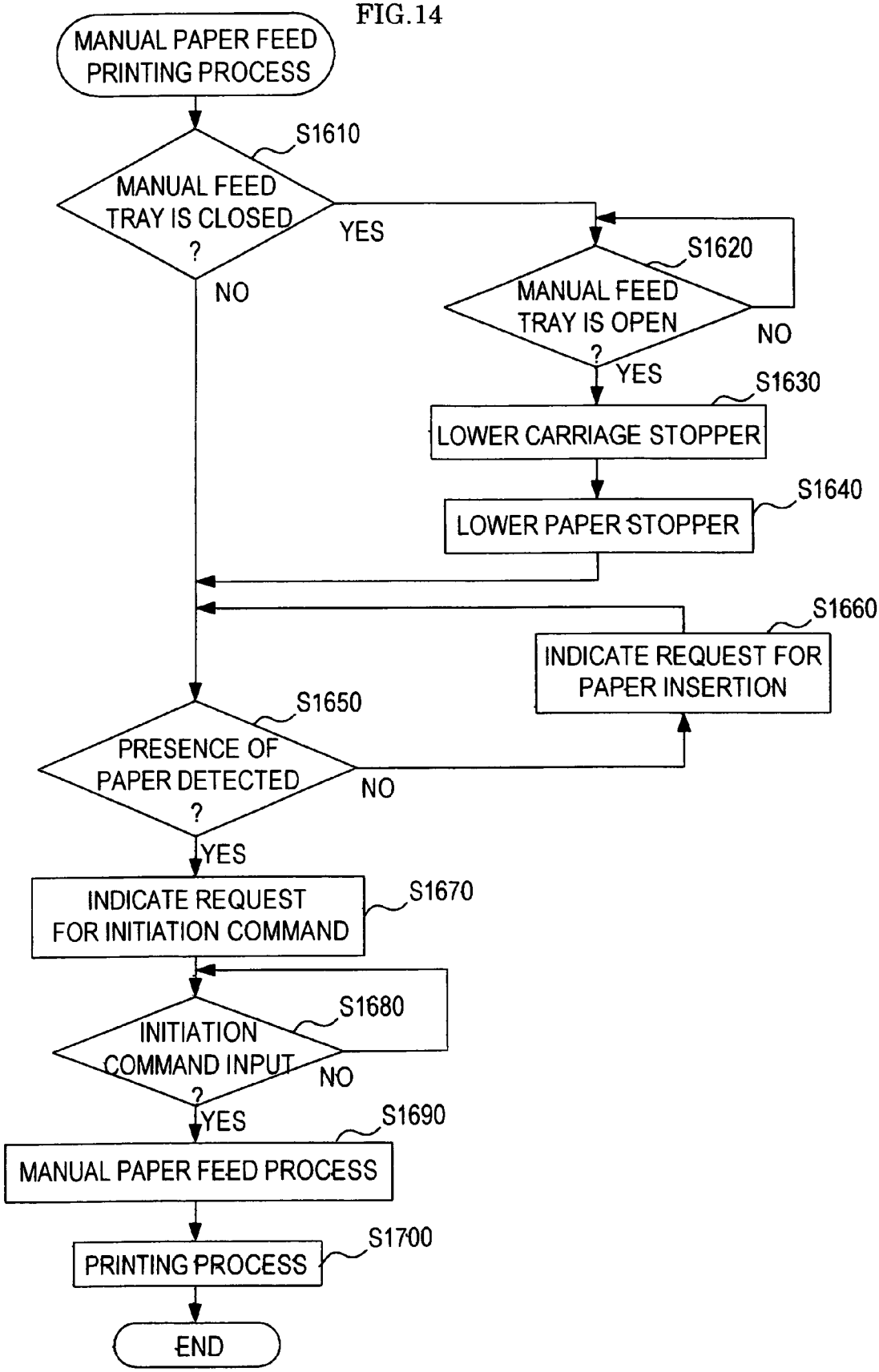
FIG. 14 is a flowchart to show the procedure of the manual paper feed printing process of another embodiment.

In the above embodiment, when the manual feed tray 102 opens, the projection portion 102*b* pushes the rotation lever 141. When the rotation lever 141 is pushed, the cam 143 moves to the position to lower the stopper 140, the stopper 140, consequently, lowers. It is also possible to constitute the mechanism as shown in FIGS. 13 and 14: when it is detected that the state of the manual feed tray 102 has changed from the closed state to the open state capable of a paper insertion, the control mechanism 400 allows the feed motor 220 to drive in order to move the cam 143 to the position to lower the stopper 140, and the stopper 140, as a result, lowers as illustrated as S1260 in FIG. 13 and S1640 in FIG. 14. With this constitution, an interruption of the stopper 140 to a paper insertion can be avoided when paper P is inserted from the manual feed tray 102, and the rotation lever 141 can be dispensed from the paper feeding apparatus 100.

FIG. 13 is a flowchart illustrating the procedure of the non-printing process of FIG. 10 to which the process of S1260 is added. FIG. 14 is a flowchart illustrating the procedure of the manual paper feed printing process of FIG. 12; to which the process of S1640 is added. In other words, FIG. 13 shows the same procedure except for the added process of S1260, and FIG. 14 shows the same procedure except for the added process of S1640.

What is claimed is:

1. A paper feeding apparatus, comprising:

a paper feed device comprising:

a paper loading board to load paper obliquely;

an abutting surface arranged in a lower part of the paper loading board, the abutting surface abuts a leading edge of the paper loaded on the paper loading board;

a feed roller abuts a surface of the paper to feed the paper to a predetermined direction sheet by sheet; and a manual feed tray movable between an open position and a closed position;

a stopper movable between a lower position lower than the abutting surface and a higher position higher than the abutting surface; and a stopper drive device which moves the stopper between the lower position and the higher position, wherein the stopper contacts the leading edge of the paper and lifts up the leading edge of the paper as the stopper is moved toward the higher position, and wherein the stopper drive device moves the stopper toward the lower position in response to the manual feed tray being at or moving to the open position.

2. The paper feeding apparatus according to claim 1, wherein the stopper drive device comprises a linking mechanism arranged between the manual feed tray and the stopper to move the stopper toward the lower position as the manual feed tray is moved to the open position.

3. The paper feeding apparatus according to claim 2, wherein the stopper drive device further comprises:

a rotational shaft facing the stopper as the linking mechanism;

a cam fixed on the rotational shaft; and a projection portion fixed on one axial end of the rotational shaft; and wherein the stopper comprises:

a stopper body that abuts the leading edge of the paper loaded on the paper loading board; and an abutting unit that extends from the stopper body and abuts the cam to provide vertical movement to the stopper body depending on a position of the cam;

wherein the manual feed tray pushes the projection portion when in the open position for insertion of the paper, and wherein the cam moves to another position to lower the stopper body when the projection portion is pushed.

4. The paper feeding apparatus according to claim 3, further comprising:

a change detection device to detect a change in the open/closed position of the manual feed tray; and a control device operably connected to the stopper drive device to permit the stopper drive device to raise the stopper when the change detection device detects that a state of the manual feed tray has changed from the open position to the closed position.

5. The paper feeding apparatus according to claim 1, further comprising:

a change detection device to detect a change in the open/closed position of the manual feed tray; and a control device operably connected to the stopper drive device to permit the stopper drive device to lower the stopper when detecting that a state of the manual feed tray has changed from the closed position to the open position to permit insertion of the paper.

6. The paper feeding apparatus according to claim 5, wherein the control device permits the stopper drive device to raise the stopper when the change detection device detects that the state of the manual feed tray has changed from the open position to the closed position.

7. The paper feeding apparatus according to claim 4, the stopper drive device further comprising:

a first gear arranged on one axial end of the rotational shaft to rotate with the rotational shaft;

a second gear geared with the first gear; and a rotational force transmission device to transmit rotational force given from a driving source to the second gear;

wherein the control device drives the driving source so that the cam moves to a position to lower the stopper body when the manual feed tray is in the open position to permit paper insertion, and to another position to raise the stopper body when the manual feed tray is not in the open position.

8. The paper feeding apparatus according to claim 7, wherein the second gear comprises a rotation limit device which does not transmit a rotational force to the first gear in a descendent direction of the stopper after the stopper is in the lower position.

9. An image formation apparatus, comprising:

a paper feeding apparatus including:

a paper feed device comprising:

a paper loading board to load paper obliquely;

an abutting surface arranged in a lower part of the paper loading board, the abutting surface abuts a leading edge of the paper loaded on the paper loading board;

a feed roller abutting a surface of the paper to feed the paper to a predetermined direction sheet by sheet; and a manual feed tray movable between an open position and a closed position;

a stopper movable between a lower position lower than the abutting surface and a higher position higher than the abutting surface; and a stopper drive device which moves the stopper between the lower position and the higher position;

an image formation device which forms an image on the paper;

a paper transfer device transfers paper fed from the paper feeding apparatus to the image formation device;

a paper detection device arranged in the paper transfer device detects when paper is fed to the paper transfer device; and a feed control device drives the paper feeding apparatus to feed the paper on the paper loading board to the paper transfer device when a command to select an automatic paper feed is externally inputted to select a paper feed from the paper loading board, subsequently chives the paper transfer device to transfer the paper fed from the paper feeding apparatus to the image formation device when the paper detection device detects the presence of paper, and drives the paper transfer device to transfer paper inserted from the manual feed tray to the image formation device, wherein the stopper contacts the leading edge of the paper and lifts up the leading edge of the paper as the stopper is moved toward the higher position, and wherein the stopper drive device moves the stopper toward the lower position in response to the manual feed tray being at or moving to the open position.

10. The image formation apparatus according to claim 9, further comprising:

an opening/closing detection device to detect whether the manual feed tray is in the open position for inserting paper; and a first annunciation device operably connected to the image formation apparatus that prohibits the process of the feed control device and announces that paper is jammed within the image formation apparatus when a command to select an automatic paper feed is inputted, if the opening/closing detection device detects that the manual feed tray is not in the open position and the paper detection device detects the presence of paper.

11. The image formation apparatus according to claim 9, further comprising:

an opening/closing detection device to detect whether the manual feed tray is in the open position for inserting paper; and a first annunciation device that announces a requirement for insertion of the paper from the manual feed tray when a command to select a manual paper feed is externally inputted, if the opening/closing detection device detects that the manual feed tray is in the open position to permit insertion of the paper, and if the paper detection device detects that the paper has not been fed.

12. The image formation apparatus according to claim 9, further comprising:

an opening/closing detection device to detect whether the manual feed tray is in the open position to permit insertion of the paper;

a command input device for inputting a feed initiation command, the feed initiation command initiates a paper feed from the manual feed tray; and a first annunciation device to announce a requirement for an input of the feed initiation command when a command to select a manual paper feed is externally inputted, if the opening/closing detection device detects that the manual feed tray is in the open position to permit insertion of the paper, and the paper detection device detects the presence of the paper, wherein the feed control device allows the paper transfer device to initiate a paper transfer when the feed initiation command is inputted from the command input device.

13. The image formation apparatus according to claim 9, further comprising:

a change detection device, wherein a driving source which drives the paper transfer device is configured to execute a predetermined preprocess other than a paper transfer prior to an image formation when driving the paper transfer device in an opposite direction to a direction of the paper transfer; and the feed control device executes the preprocess by driving the driving source in the opposite direction when the change detection device detects that a state of the manual feed tray has changed from the closed position to the open position to permit insertion of the paper.

14. A computer-readable storage medium storing thereon a control program executable by a processor controlling the paper feeding apparatus according to claim 4, the program comprising:

detecting a change in the open/closed position of the manual feed tray; and raising the stopper when the detection of the manual feed tray has changed from the open position to the closed position.

15. A computer-readable storage medium storing thereon a control program executable by a processor controlling the image formation apparatus according to claim 10, the program comprising:

detecting whether the manual feed tray is in the open position for inserting the paper; and prohibiting the process of the feed control device and announcing that the paper is jammed within the image formation apparatus when selection of an automatic paper feed is inputted, if the detection of the manual feed tray is not in the open position and the presence of the paper is detected by the paper detection device.

16. A computer-readable storage medium storing thereon a control program executable by a processor controlling the image formation apparatus according to claim 11, the program comprising:

detecting whether the manual feed tray is in the open position for inserting the paper; and announcing a requirement for a paper insertion from the manual feed tray when the selection of the manual paper feed is externally inputted, if the detection of the manual feed tray is in the open position to permit insertion of the paper, and if the paper has not been fed.

17. A computer-readable storage medium storing thereon a control program executable by a processor controlling the image formation apparatus according to claim 12, the program comprising:

detecting whether the manual feed tray is in the open position to permit the insertion of the paper;

initiating a paper feed from the manual feed tray; and announcing a requirement for an input of the feed initiation command when the selection of a manual paper feed is externally inputted, if the detection of the manual feed tray is in the open position to permit insertion of the paper, and the presence of the paper is detected by the paper detection device, and initiating the paper transfer when the feed initiation command is inputted.

18. A computer-readable storage medium storing thereon a control program executable by a processor controlling the image formation apparatus according to claim 13, the program comprising:

executing a predetermined preprocess other than the paper transfer prior to an image formation when driving the paper transfer device in an opposite direction to a direction of the paper transfer; and executing the preprocess by driving the driving source in the opposite direction when detecting the state of the manual feed tray has changed from the closed position to the open position to permit insertion of the paper.

19. The paper feeding apparatus according to claim 1, wherein the stopper raises and lowers each time the paper is fed from the paper loading board.

20. The paper feeding apparatus according to claim 1, wherein the stopper drive device rotates to move the stopper vertically with respect to the abutting surface.

21. The image formation apparatus according to claim 9, wherein the stopper drive device rotates to move the stopper vertically with respect to the abutting surface.

* * * * *